US005505115A

United States Patent [19]

Vandervoort

[11] Patent Number: 5,505,115

[45] Date of Patent: Apr. 9, 1996

[54] KEYBOARD KEY RETURN AND MOTION SENSING MECHANISMS INCORPORATING A SWING ARM

[76] Inventor: Paul B. Vandervoort, 2875 Idlewild Dr., #19, Reno, Nev. 89509

[21] Appl. No.: 345,067

[22] Filed: Nov. 22, 1994

Related U.S. Application Data

[63] Continuation-in-part of Ser. No. 191,283, Feb. 3, 1994, abandoned, which is a continuation-in-part of Ser. No. 40,209, Apr. 1, 1993, abandoned.

[51] Int. Cl.[6] ..... G10C 3/12

[52] U.S. Cl. ..... 84/423 R; 84/719; 84/744; 84/DIG.7; 200/343; 400/479; 400/490

[58] Field of Search ..... 84/423 R, 433–436, 84/439–440, DIG. 7, 719, 744; 200/343, 517; 400/479, 490

[56] References Cited

U.S. PATENT DOCUMENTS

| | | | |
|---|---|---|---|
| 5,010,219 | 4/1991 | Kato | 200/517 |
| 5,243,125 | 9/1993 | Yamaguchi | 84/423 R |

*Primary Examiner*—Patrick J. Stanzione

[57] ABSTRACT

A keyboard includes a key which drives a swing arm. The swing arm transfers return force from a coil spring or other return force mechanism to the key. The rotational axis of the swing arm is perpendicular to the length of the keyboard. Various key position sensing means utilizing the swing arm are disclosed as well.

23 Claims, 9 Drawing Sheets

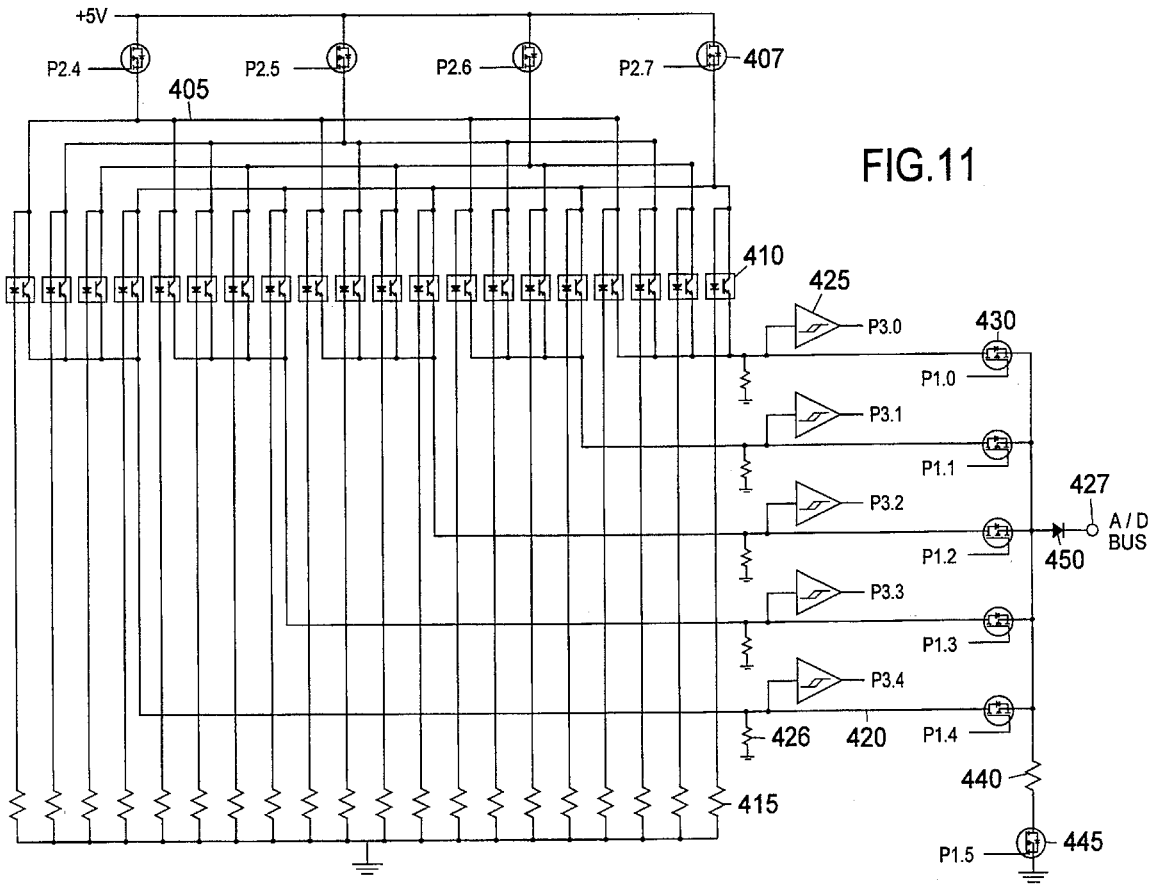
FIG.11
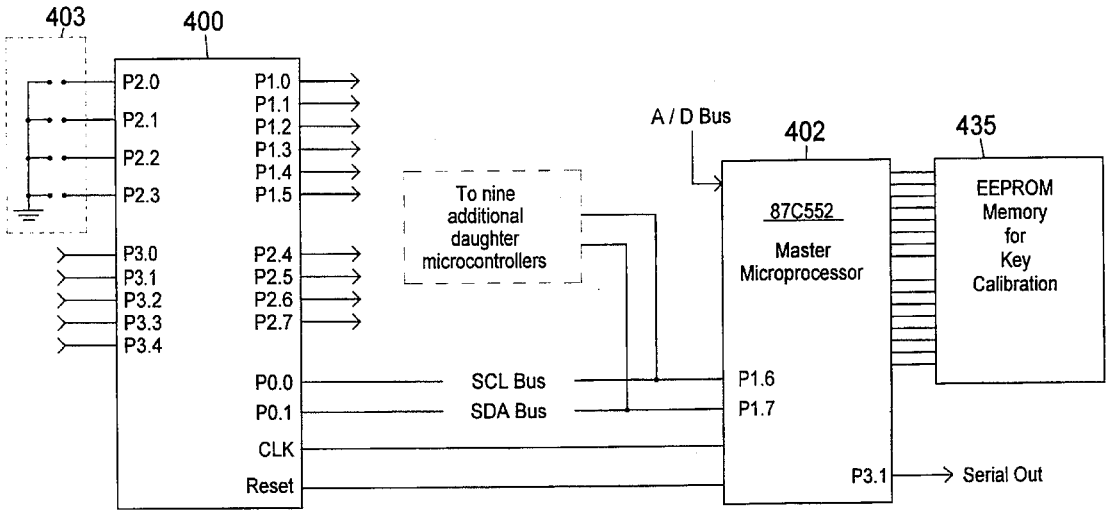

+5V
P1.0
460
P1.1
P1.2
P1.3
P1.4
407

+5V
475
P3.0
P3.1
P2.4
P3.2
P3.3
P2.5
427
A / D
BUS
450
P3.4
P3.5
P2.6
P3.6
P3.7
465
470
P2.7
415
440
P1.5
445
403
480
P2.0
P2.1
P2.2
P2.3
P1.0
P1.1
P1.2
P1.3
P1.4
P1.5
P2.4
P2.5
P2.6
P2.7
P3.0
P3.1
P3.2
P3.3
P3.4
P3.5
P3.6
P3.7
P0.0
P0.1
CLK
Reset
To nine additional daughter microcontrollers
SCL Bus
SDA Bus
A / D Bus
485
87C552
Master Microprocessor
P1.6
P1.7
P3.1
Serial Out
490
EEPROM Memory for Key Calibration

| FIG. 15 (This chart refers to FIG. 14) | | KEY ROWS 1 | 2 | 3 | 4 | 5 |
|---|---|---|---|---|---|---|
| PHOTODIODE INPUT BUSES | 565 | Q | S | R | Q | S |
| | 566 | R | Q | S | R | Q |
| | 567 | S | R | Q | S | R |
| SWITCH 555 | Bass Board | T | T | U | U | U |
| | Treble Board | T | T | T | T | T |
| PHOTOTRANSISTOR OUTPUT BUSES | 505 | I | L | L | K | I |
| | 506 | J | M | O | P | N |
| | 507 | K | K | K | K | K |
| PHOTODIODE OUTPUT BUSES | 575 | V | V | V | Y | Y |
| | 576 | W | W | W | V | V |
| | 577 | X | X | X | W | W |
| | 578 | Y | Y | Y | X | X |

KEYBOARD KEY RETURN AND MOTION SENSING MECHANISMS INCORPORATING A SWING ARM

This is a continuation-in-part of application Ser. No. 08/191,283, filed Feb. 3, 1994 for "Keyboard Key Return and Motion Sensing Mechanism Incorporating a Swing Arm", abandoned, which is a continuation-in-part of application Ser. No. 08/040,209 for "Linearly Reciprocating Keyboard Key Incorporating Two Guide Pins" filed Apr. 1, 1993, abandoned.

FIELD OF THE INVENTION

This invention relates to a keyboard in a musical instrument, word processor or other finger-operated device wherein a key is reciprocated along an axis of motion by the finger of the operator. Generally, this axis is approximately vertical, but may be horizontal in certain applications, such as an accordion.

BACKGROUND OF THE INVENTION

It is desirable in some types of keyboards to incorporate a key return mechanism which provides downstroke resistance which decreases as the key is depressed. An example of such a keyboard is one incorporating a tactile orientation system, e.g., Braille. Another tactile orientation system is described in the present applicant's U.S. Pat. application for "Tactile Key Tops," Ser. No. 173,855, filed Dec. 22, 1993. The key return means must provide sufficient initial downstroke resistance to allow the operator to feel a tactile feature on a key top without depressing the key. At the same time, however, it is generally desirable to minimize the overall energy, i.e., force through distance, which is required to fully depress the key. Minimizing this overall required energy reduces finger fatigue. To provide optimum initial downstroke resistance while minimizing finger fatigue, downstroke resistance which decreases during key depression is thus required.

Also, in some applications, e.g., musical keyboards, the operator is often required to hold one or more keys in depressed position for a period of time. If each key provides a low upward force when fully depressed, finger fatigue will be further reduced in these applications.

Other advantages of decreasing downstroke resistance are discussed in various prior art including U.S. Pat. Nos. 3,478,857 (Linker) and 4,476,769 (Kumano).

Various key return means have been developed in the prior art which provide decreasing downstroke resistance. One such means utilizes a swing arm, or rotor, which serves to transmit return force from a key return element (such as a coil spring, leaf spring, or weight) to a key. The swing arm/key combination may be geometrically configured to provide decreasing downstroke resistance to the striking surface of the key.

In all examples of the known prior art which apply swing arms to musical keyboards, the swing arms are disposed to rotate on a longitudinal axis, i.e., an axis parallel to the length of the keyboard. This axis disposition has been found in the prior art to necessitate swing arm mounting structures which are complex, bulky and costly.

Swing arms can also be found in self-contained switches of the type used in computer keyboards. Examples are shown in U.S. Pat. Nos. 4,249,055 (Matsuo) and 4,803,316 (Hayashi). These switches are relatively compact, but are formed of a large number of parts and thus are expensive to manufacture. In each of these switches, a key position sensing element is operated directly by the swing arm. This aids in forming a compact mechanism. However, the key position sensing element in each switch has its own miniature circuit board. This circuit board is in addition to the master circuit board which the switch is mounted on. Other structures, such as the switch housing, add manufacturing cost as well. Furthermore, the swing arm of one of these switches is very small in size and thus cannot accommodate a large key dip directly. A coil spring may be used as a link between the plunger and swing arm as in the two patents mentioned in this paragraph above. This spring allows for increased key dip, but introduces an initially increasing return force on the key. This increasing return force is sometimes undesirable as set forth above. For these and other reasons switches of this type are not well suited for musical applications.

In applying a swing arm mechanism to a Janko Keyboard with independent keys (as described in the grandparent application of this specification) one finds that the above mentioned drawbacks of the prior art take on increased significance. Space underneath the keyboard is at a premium. There is little room for the support structure, or frame, and necessary mechanisms such as key return means, key motion sensing means, bushings, guides, and limit-of-travel stopping means. With slidably interlocking chassis rails supporting the key rows as described in the grandparent application and also described below, swing arms with longitudinal axes would have to be very short or would have to pass through ports in the rails, which would increase manufacturing costs. Furthermore, with 2.5 times the standard number of keys (assuming a 5-row design) the cost of self-contained switches becomes quite high.

OBJECTS OF THE INVENTION

Accordingly, the objects of the present invention include:

(a) to provide a key return and sensing mechanism which is compact;

(b) to provide a key return and sensing mechanism which is lightweight;

(c) to provide a key return and sensing mechanism which is durable;

(d) to provide a key return and sensing mechanism which may be engineered with minimal friction, or with a given friction component, if desired;

(e) to provide a key return and sensing mechanism which operates quietly;

(f) to provide a key return and sensing mechanism which may be engineered to provide decreasing downstroke resistance, if desired;

(g) to provide a key return and sensing mechanism which can be easily assembled, disassembled, and repaired; and, (h) to provide a key return and sensing mechanism which can be manufactured at low cost.

SUMMARY OF THE INVENTION

To achieve these objects, a keyboard is provided with a chassis which may include a circuit board, and a row of keys defining a keyboard axis. At least one key within the key row is reciprocatively mounted on the chassis. The axis of key reciprocation may be curved, as in the case of a standard piano key, or this axis may be linear, as in the case of a standard computer keyboard key.

A swing arm is rotatably mounted on the chassis and is disposed to revolve as a result of reciprocative key movement. The key may drive the swing arm directly, via a guide pin, or via a driving member, and may also drive the swing arm via a link. A firm link, such as a pushrod, cable, chain, or hook may be employed.

The swing arm is disposed to revolve around an axis which is substantially perpendicular to the keyboard axis. Thus, the swing arm may occupy less space than swing arms of the prior art in the transverse dimension, the vertical dimension, or both.

The swing arm axis may also be substantially perpendicular to the circuit board. In this embodiment, the plane defined by the arc of swing arm movement is parallel to the surface of the circuit board. This configuration turns out to have broad advantages:

(1) The swing arm may be mounted on a simple axle, which may be inexpensively mounted on the circuit board.

(2) The swing arm may also drive a contact spring, which may reciprocate with key movement between two simple contact posts. These posts may be inexpensively mounted on the circuit board. This embodiment is disclosed in this specification's grandparent application.

(3) The return spring may be disposed in close proximity to the circuit board, making it convenient to utilize the return spring directly as a key position sensing element. For example, two flexible contact posts may be provided on the circuit board, one disposed on each side of the return spring. The stationary end of the return spring and the flexible contact posts may then be electrically connected to a sensing circuit. In this way the return spring may serve the function of the contact spring in the embodiment mentioned in the preceding paragraph.

(4) Other key position sensing elements may be used alternately in conjunction with the swing arm.

(5) The various elements of the mechanism may be compact while at the same time easily accessable for assembly or repair.

The key applies a driving force vector to the swing arm at a driving contact point. The key return element provides a return force vector to the swing arm at a return force contact point. To compensate for the increase in spring force due to spring deflection and/or to provide decreasing downstroke resistance, the driving force vector (shown in a pushrod embodiment in FIG. 5, denoted by *) is applied to the swing arm at an obtuse angle (one such angle is shown in FIG. 5 denoted by U) when the key is at rest position; and the return force vector (shown in FIG. 6, denoted by I) is applied to the swing arm at an obtuse angle (see FIG. 6, angle Z+90) when the key is fully depressed.

The keyboard may employ a plurality of adjacent keys with corresponding adjacent swing arms. To simplify the structure, it is advised that adjacent swing arms be disposed in alignment with each other along a longitudinal axis. Since the pivot axes of these swing arms are perpendicular to this longitudinal axis, the overall radii of the swing arms is thus limited by the spacing of adjacent swing arms. To further simplify the structure, it is also advised that this spacing be identical to the spacing of the corresponding keys. Thus, the radii of the swing arms is limited to the spacing of the corresponding keys. Nevertheless, in the embodiments hereinafter disclosed, it has been found that this available radius is more than adequate to engineer a swing arm which produces a satisfactory touch response.

ORIENTATION TERMS AND DISCLAIMER

In this specification and appended claims orientation terms are based on the orientation of a musician as most commonly positioned at a piano keyboard; thus:

The longitudinal axis is that which extends from the left, or bass end of the keyboard to the right, or treble end.

The lateral or transverse axis is that which extends from the front to the rear of the keyboard.

The vertical axis refers to the key axis of motion. Thus, the guide pins of the Janko embodiment disclosed below are considered vertical. The key surface normally depressed by the finger of the operator during operation is referred to as the key "top."

These orientation terms are intended only to convey the placement of the various parts and elements in relation to each other and to facillitate description and understanding of various parts, elements and events. They are not intended to convey any limitation on the placement of the keyboard in relation to the direction of gravitational force or to the physical orientation of the operator. The invention and the preferred embodiments, properly engineered, may be tilted on any horizontal axis to any angle during or after assembly and still be made to operate without detriment to performance. An example of an alternative angle application is an accordion.

BRIEF DESCRIPTION OF THE DRAWING FIGURES

Figure 7:
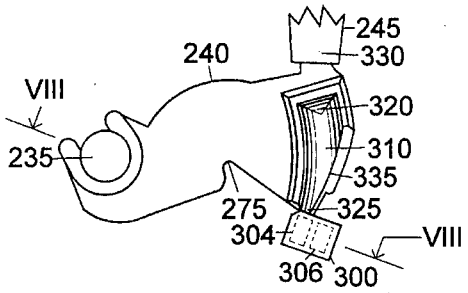
FIG. 7 shows a front view of a swing arm utilizing a reflective-type photointerrupter to sense key position. This figure is drawn as though the key row circuit board and key frame rail are invisible.
Figure 8A:
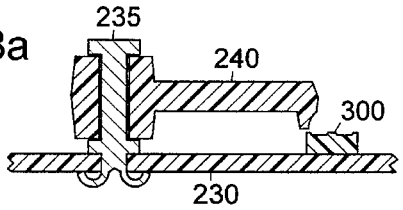
Figure 8B:
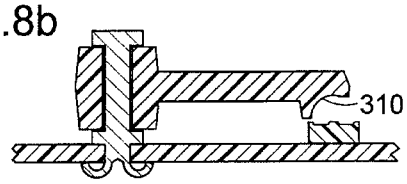
Figure 8C:
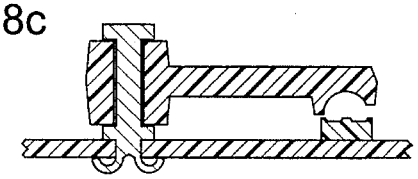
Figure 8D:
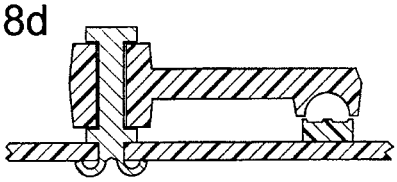

FIGS. 8*a–d* show a cross-sectional view of the swing arm of FIG. 7 taken along line VIII in various stages of key depression.

Figure 9:
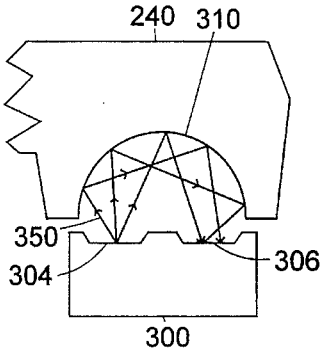

FIG. 9 shows a close-up of the sensing area of the FIG. 8 structure with lines showing a light reflecting pattern depression.

Figure 10A:
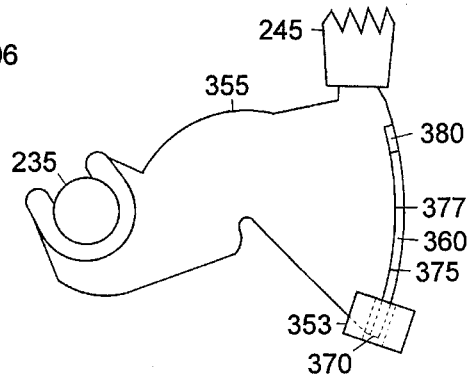

FIG. 10*a* shows a front view of a swing arm utilizing a transmissive-type photointerrupter to sense key position. This figure is drawn as though the key row circuit board and key frame rail are invisible.

Figure 10B:
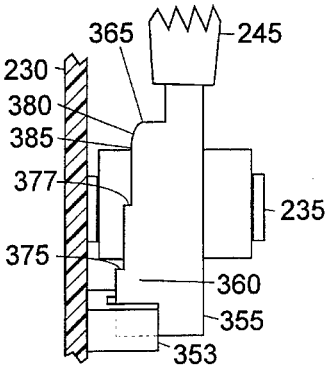

FIG. 10*b* shows a side view of the structure of FIG. 10*a*.

FIG. 11 shows an electronic schematic diagram of a key position sensing circuit for a 200-key keyboard according to the invention.

Figure 12:
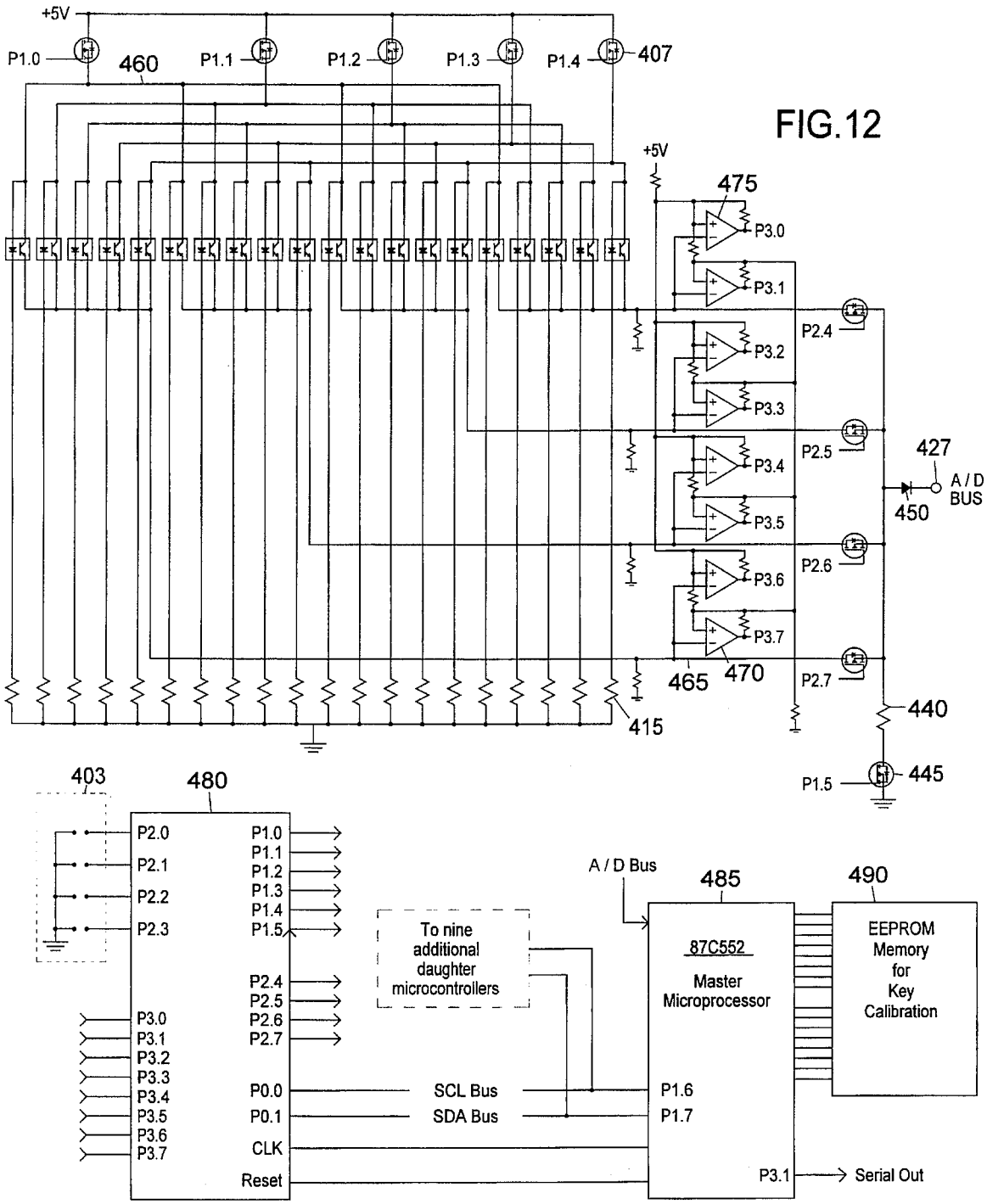

FIG. 12 shows an electronic schematic diagram of an alternate key position sensing circuit for a 200-key keyboard according to the invention.

Figure 13:
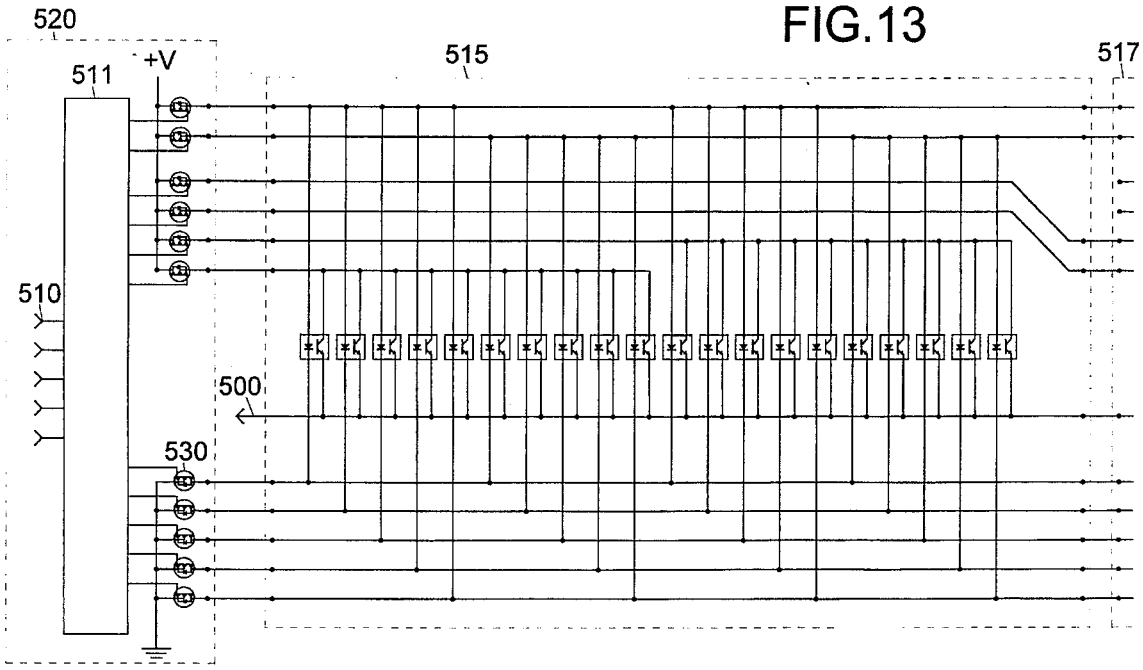

FIG. 13 shows a simplified electronic schematic diagram of a matrix circuit for an alternate key position sensing circuit for a 200-key keyboard according to the invention.

Figure 14:
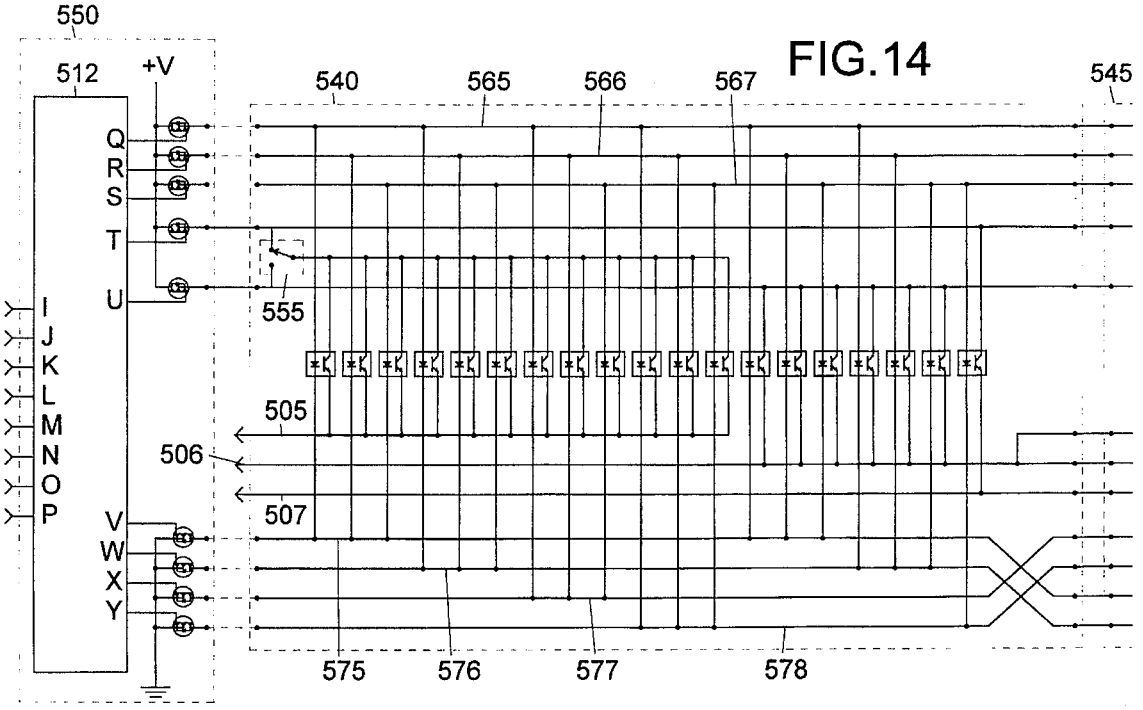

FIG. 14 shows a simplified electronic schematic diagram of a matrix circuit for a key position sensing circuit for a 190-key keyboard according to the invention.

FIG. 15 is a chart explaining details of the matrix of the FIG. 14 embodiment.

Figure 16A:
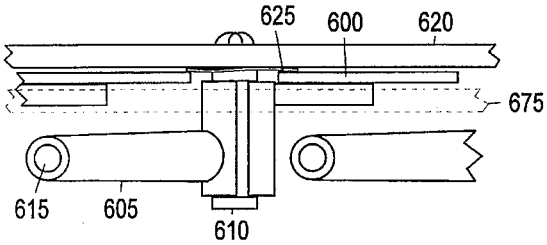

FIG. 16*a* is an overhead view of a swing arm capacitive sensing system according to the invention.

Figure 16B:
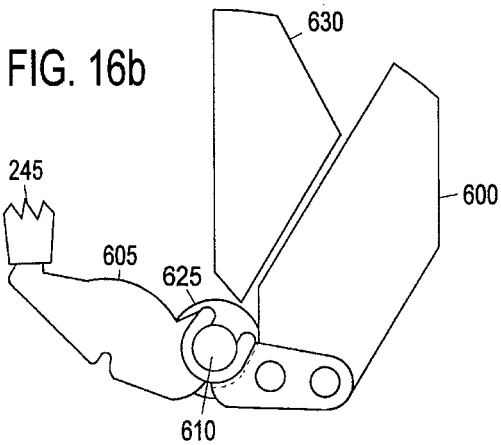

FIG. 16*b* is a rear view of the structure of FIG. 16*a*.

Figure 17:
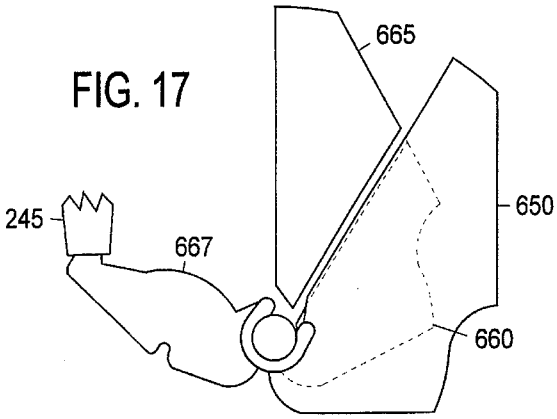

FIG. 17 is a rear view of an alternate swing arm and capacitive sensing system.

Figure 18:
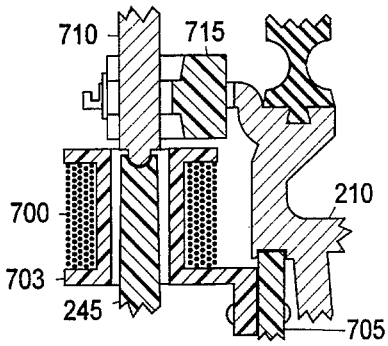

FIG. 18 is a side cross-sectional view of the upper rear portion of an independent-key Janko Keyboard frame and guide structure according to the invention with an inductive coil sensing system.

Figure 19:
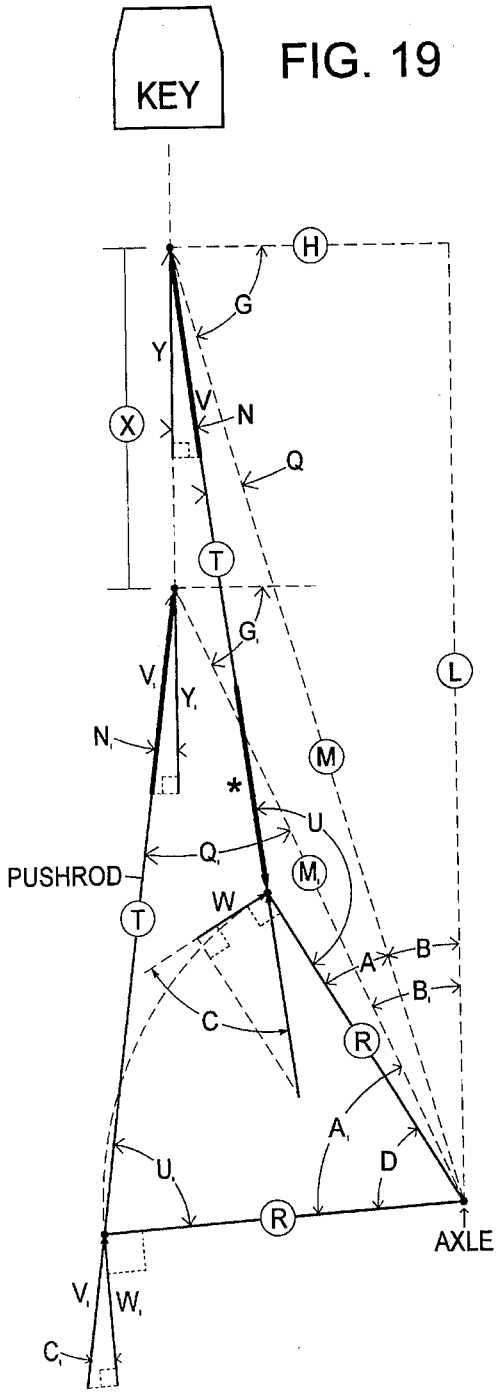

FIG. 19 shows a geometric analysis of a key, pushrod and swing arm according to the invention.

Figure 20:
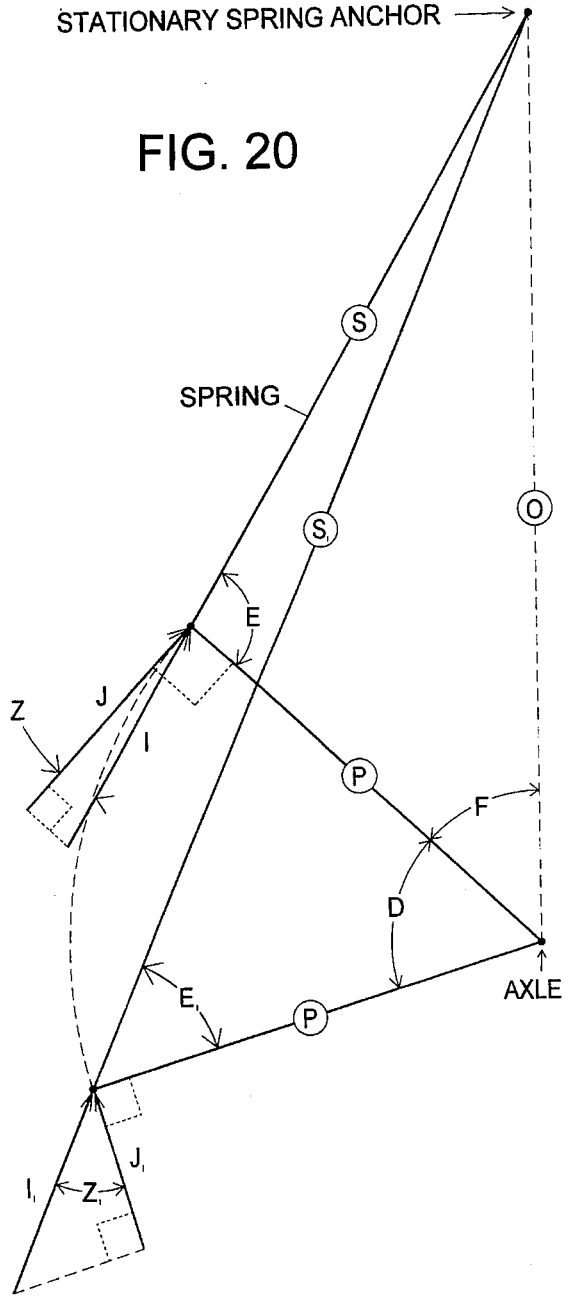

FIG. 20 shows a geometric analysis of a return spring and swing arm according to the invention.

CONVENTIONAL KEYBOARD EMBODIMENT

Figure 1:
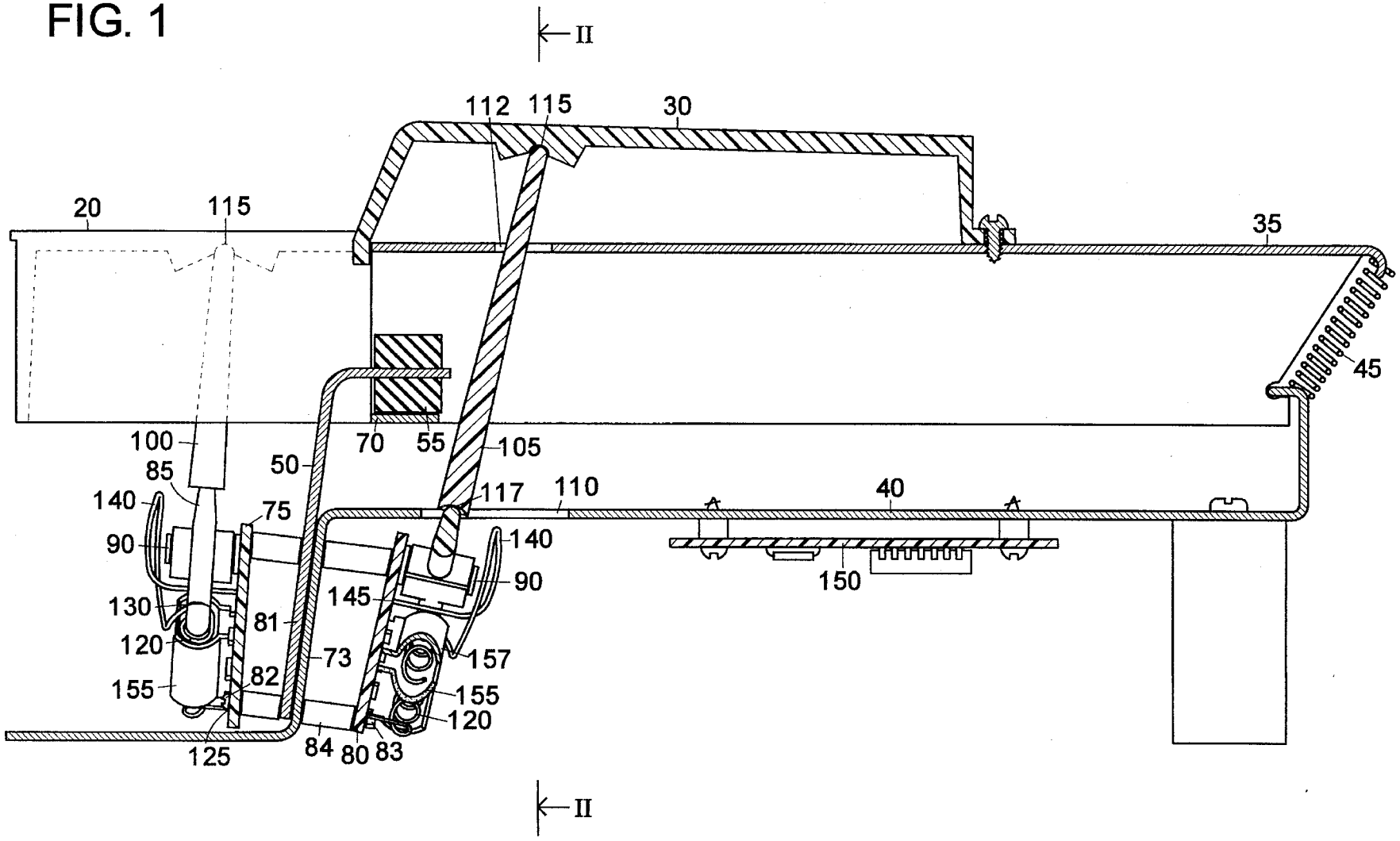
FIG. 1 shows a side cross-sectional view of a conventional keyboard according to the invention.
Figure 2:
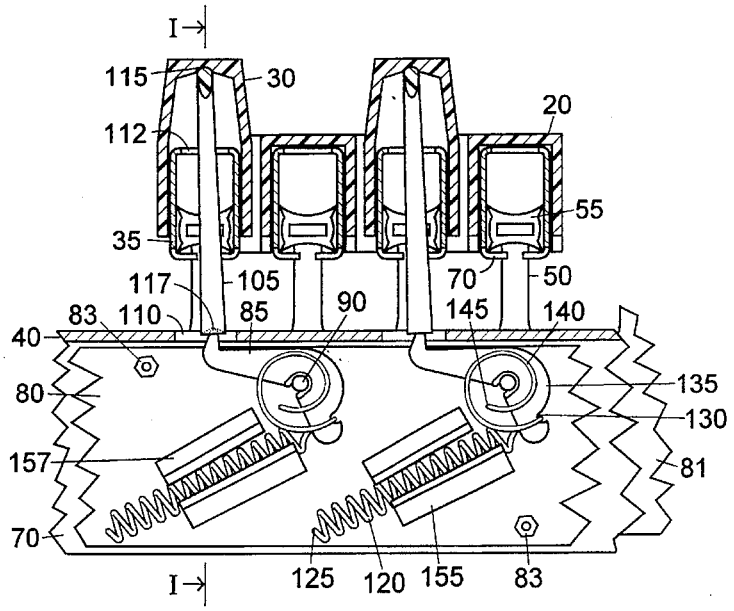
FIG. 2 shows a cross-sectional view of a conventional keyboard according to the invention as viewed from the rear.

The invention may be applied to a conventional musical keyboard. Referring now to FIGS. 1 and 2, a plurality of injection-formed thermoplastic white keys 20 and black keys 30 are provided. Each key is firmly mounted on a channel 35. The open side of each channel is disposed facing downward. These channels are formed of sheet metal and are swingably mounted on a sheet metal frame 40. This frame may alternately be formed of extruded aluminum. Each channel is provided with a compression spring 45 to keep the channels swingably attached to the frame.

A guide finger strip 50 is provided with rubber guide members 55 to guide the keys. This key guiding method is similar to that shown in U.S. Pat. No. 3,722,351 (Allen, et al.). Each channel 35 is provided with a pair of flanges 70 at the front underside which are folded inward. These flanges contact their corresponding guide members 55 at key rest position and serve to limit upward key travel. The top undersides of the channels 35 contact their corresponding guide members at key full depression position and serve to limit downward key travel. The guide members 55 are structured to allow slight additional downward travel after the key is depressed to the point of contact for MIDI poly-pressure or channel pressure data transmission, which is discussed further below.

The frame 40 includes an approximately vertical portion 73 which extends the length of the keyboard and is laterally disposed approximately below the front ends of the black keys. Disposed forward of this vertical frame portion is a white keys circuit board 75. Disposed to the rear of vertical frame portion 73 is a black keys circuit board 80. These circuit boards are disposed approximately vertically and extend the length of the keyboard. Laterally, these circuit boards are disposed near the front ends of their corresponding keys. Interposed between the vertical frame portion 73 and the white keys circuit board 75 is the anchor portion 81 of guide finger strip 50. The two circuit boards and the guide finger strip are attached to the vertical frame portion 73 by a plurality of machine screws 82 and nuts 83 which pass through holes in these elements as well as through spacers 84. This arrangement helps to keep manufacturing costs low, since one set of screws and nuts is utilized to mount these three separate elements. Rivets may be used alternately, not shown.

Each key is provided with a swing arm 8B, swingably mounted on a metal axle 90 which is staked through a bore in the corresponding circuit board. The axis of each axle is perpendicular to the planar surfaces of its corresponding circuit board. The white key swing arms are mounted adjacent the front surface of the white keys circuit board 79. The black key swing arms are mounted adjacent the rear surface of the black keys circuit board 80. Each swing arm is driven by a pushrod 100, 105. The swing arms and pushrods may be injection-formed of Delrin ® or similar material.

The black key pushrods 105 pass through holes 110 which are punched or bored in the frame 40. These holes are oval shaped, extending rearward past the swing arm position to facillitate assembly by allowing the black key pushrods 10B to clear their corresponding swing arms during insertion. Each black key pushrod 10B also extends through a hole 112 in the top of its corresponding channel 3B. To simplify the construction process and to make the black and white key channels interchangable, the white key channels may also be formed with holes 112. The top end of each pushrod is rounded and rests in a similarly rounded crater 115 on the underside of the corresponding key. The bottom end of each pushrod 100, 105 is concave and mates with an upwardly-extending tip portion 117 at the swinging end of its corresponding swing arm 85.

A coil extension-type return spring 120 is provided for each key. Each return spring is anchored at its stationary end through a bore 125 in its corresponding circuit board. The moving end of the return spring is anchored at a return force contact point on the swing arm. This point is comprised of a notch 130 near the end of a return spring member 135 on the swing arm. To allow for long return springs and to dispose the return spring swing arm member clear of the swing arm of the adjacent key, the return spring is disposed diagonally-extending downward and sideways longitudinally from the notch 130. The curved portion may extend away from the circuit board (not shown) rather than parallel to the circuit board as shown. Alternately, the moving end of the return spring may be electrically connected to the circuit board via a separate wire (not shown) which may be more flexible and of lighter gauge than the return spring wire. This alternate wire may be soldered or spot welded to the moving end of the return spring. Alternately, either wire may be soldered to the tip of axle 90 instead of passing through hole 145.

Printed circuit traces (not shown) match with holes 125, 145 and are soldered to the corresponding ends of the return spring. In the alternate embodiment with the wire soldered to the axle, hole 145 is eliminated and a circuit trace is instead soldered to the base of the axle. These traces carry an alternating electric current from an electronic voltage source and measuring system (not shown) through the return spring 120. Electronic components of this voltage source and measuring system, such as capacitors or microprocessors, may be mounted on the keyboard circuit boards 75, 80 or on another circuit board 150.

The frequency and/or amplitude of the alternating current which passes through the return spring 120 is determined, in part, by the inductance of the spring. This inductance decreases with key depression, since stretching of the spring causes an increase in the distance between adjacent coil turns. To further modulate the spring inductance, a ferrite plate 155 may be mounted on the circuit board disposed underneath the return spring and in close proximity to the return spring when the key is at rest position. As the key is depressed, the return spring is elevated slightly, increasing distance from the plate 155. As an alternate or additional means of increasing inductance modulation, a ferrite rod (not shown) may be placed within the core of the return spring coil. This core rod is coated with an insulating material of low friction, such as Teflon ® or heat-shrunk polyolefin. As the spring is stretched, the number of coil turns in close proximity with the core rod is decreased. The core rod may serve the additional function of dampening spring vibration. To further modulate spring inductance, a plate 157 of non-magnetic conductive material such as aluminum may be mounted on the circuit board as shown. This plate is disposed above the return spring and in close proximity to the return spring when the key is at depressed position.

With sufficient spring inductance modulation, this key position measuring system may be utilized to provide MIDI poly-pressure and channel-pressure data. Also, by combining the return spring with the key position sensor, manufacturing costs can be reduced and the mechanism may be compact. Several U.S. Patents describe electronic inductance measuring systems which may be adopted, with modification, for use with the above described return/sensor spring. These U.S. Pat. Nos. include 4,580,478 (Brosh et al.), 4,838,139 (Fiori, Jr.), and 5,187,315 (Muramatsu et al.).

Another advantage of this mechanism is that it requires relatively few holes to be formed in the chassis, further reducing manufacturing costs. The swing arms, push rods, and keys may all be injection-formed with two-part molds, which can be inexpensively produced.

JANKO EMBODIMENT

As described in brief in this specification's grandparent application, the invention may be applied to a Janko Keyboard with independent keys.

Figure 3:
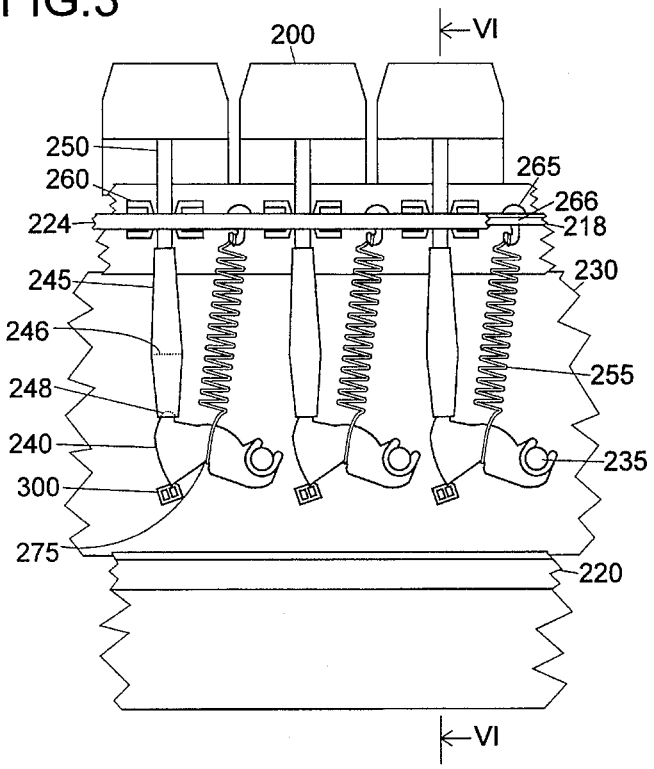
FIG. 3 shows a rear view of the top row of an independent-key Janko Keyboard according to the invention.
Figure 6:
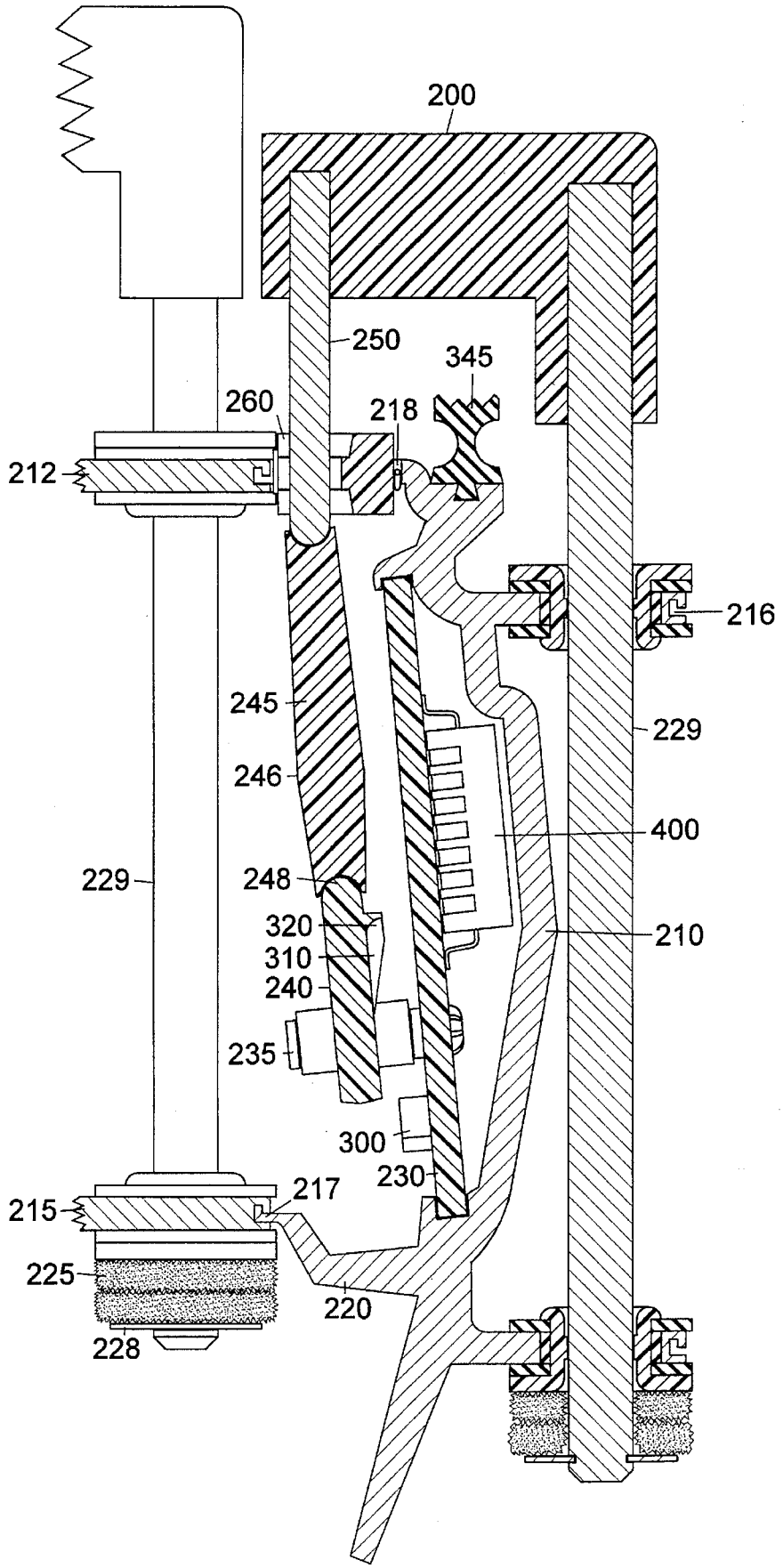
FIG. 6 shows a side cross-sectional view of an independent-key Janko Keyboard according to the invention.

Referring to FIGS. 3 & 6, a linearly reciprocating key 200 is mounted on an extruded aluminum rail 210 as described in this specification's grandparent application. Several improvements are recommended which may be applied to the keyboard without regard to the return/sensing mechanism:

(1) To reduce manufacturing costs, it is recommended that the rear guide pins be circular in cross section.

(2) It is recommended that the rails 210 be attached to each other with interlocking joints as shown in FIG. 6. The front edges of the front flanges 212, 215 include L-shaped grooves 216 which are shaped to mate with tongues 217 on the rear edge of the upper rear flange 218 and on the rear side of the lower rear flange 220. The vertical thickness of the upper rear flange 218 may be less than the vertical thickness of the front flanges 212, 215 as shown. These joints obviate the need for the cable bundling arrangement shown in the grandparent application, FIG. 2.

Figure 4:
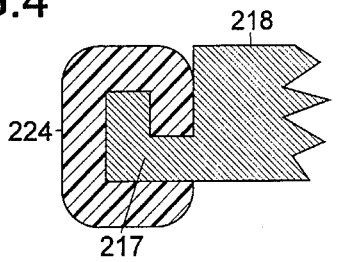
FIG. 4 shows a side cross-sectional view of an improved bumper-retaining method for the top rear flange of the top row of an independent-key Janko Keyboard according to the invention.

(3) Referring to FIG. 3 and particularly to FIG. 4, to prevent the channel-shaped bumpers 222 of the top key row from sliding rearward off the frame, an extruded plastic strip 224 is provided. This strip is C-shaped in cross-section and fits snugly around the L-shaped tongue 217 of the upper rear flange 218 of the top row. This strip obviates the need for the retaining posts which are shown in the grandparent application FIG. 5 and are denoted by the reference numeral 47. The bushing cutouts in the upper rear flange may be machined much more easily and cheaply without these retaining posts.

Figure 5:
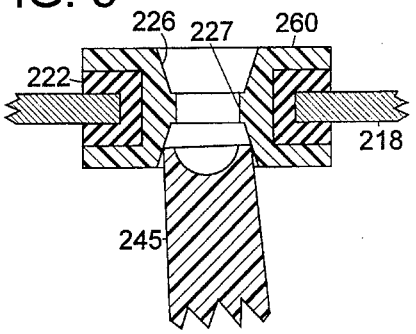
FIG. 5 shows a rear cross-sectional view of an improved pushrod and top rear bushing design with key removed for an independent-key Janko Keyboard according to the invention.

(4) Referring to FIG. 3 and particularly to FIG. 5, to facillitate various repairs of the keyboard such as cleaning and/or lubricating of the guide pins or bushings, each rear bushing 260 includes an upper and lower pair of apositioned inside surfaces 226 which are tapered as shown in FIG. 5. The end diameter of each pushrod 245 is smaller than the underside (or topside) opening of the bushing, yet larger than the smallest distance between the tapered surface pairs adjacent the pin-contacting center flanges 227. Thus, referring to FIG. 6, when E-clip 228 and felt punchings 225 are removed from front guide pin 229 and the key 200 is removed from the keyboard, the top end of pushrod 245 is wedged between lower surfaces 226 as shown in FIG. 5. With the pushrod held is place, key 200 may later be easily re-inserted without need for disconnecting adjacent rails 210. The upper inside bushing surfaces 226 are tapered symmetrically with the lower inside surfaces so that the bushing 260 may be assembled in upside-down position, streamlining the manufacturing process.

Referring now to FIGS. 3 and 6, a circuit board 230 is mounted on the rear side of rail 210 with an approximately vertical orientation. For each key, an axle 235 in staked to the circuit board via a bore near the bottom edge. A swing arm 240 is swingably mounted on this axle.

The swing arm 240 is driven by a pushrod 245. Each tip of the pushrod incorporates an identical crater. Thus, the pushrod may be installed with either tip up or down. The injection-mold part line 246 of the pushrod may be disposed closer to one tip than the other as shown to ensure that the ejection-pin end remains in the mold during mold separation. The lower tip of the pushrod cups an upwardly-pointing driving contact tip 248 on the swinging end of the swing arm 240. The upper tip of the pushrod 245 mates with the bottom tip of the rear guide pin 250. This bottom tip is rounded to seat in the pushrod tip. An alternate pushrod shape and an alternate method for mating the pushrod with the guide pin is shown and described in this specification's grandparent application.

An extension coil return spring 255 (not shown in FIG. 6) is provided. The stationary end of this spring is anchored to the top rear flange 218 between two adjacent bushings 260 via a hook 265 which rests in a hole 266 bored in top rear flange 218. The hook 265, pushrod 245, and swing arm 240 may each be injection-formed of Delrin ® or similar material. Alternately, the stationary end of spring 255 may be anchored to circuit board 230 near its top edge. This alternate return spring anchoring method is shown in FIGS. 1 & 2.

The moving end of the spring is anchored in a notch 275 on the underside of swing arm 240. This notch is disposed longitudinally between axle 235 and driving contact tip 248.

Spring 255 and pushrod 245 are disposed side-by-side and are approximately vertical. This configuration has several advantages:

(1) The push rod may be relatively long, thus reducing the number of angular degrees which the swing arm must rotate to accommodate a given key dip; thus reducing the swing arm radius required for a satisfactory touch response.

(2) Less side force is imparted on the axle and therefore less friction is present than on the axle shown in FIG. 2.

(3) With a given available vertical space for the mechanism, a long pushrod and a long return spring are not mutually exclusive.

Alternately, the return spring in the Janko embodiment may be disposed below the swing arm, as shown in FIG. 2.

To sense absolute key position, a reflective-type photointerrupter 300 is provided for each key. The GP2S27 manufactured by Sharp Corp. of Japan is recommended since it is small in size and inexpensive. This photointerrupter is mounted on the rear surface of circuit board 230 and faces rearward. The infrared photodiode emitter 304, the phototransistor detector 306, and axle 235 are colinear as shown with the emitter disposed between the phototransistor and the axle.

Referring to FIGS. 3, 6, and particulary to FIGS. 7–9, swing arm 240 includes an annular concave reflecting surface 310 which is disposed concentrically around axle 235. Concave surface 310 faces forward, i.e., toward circuit board 230. Photointerrupter 300 is disposed on circuit board 230 directly in front of the moving path of reflecting surface 310. As key 200 is depressed, swing arm 240 is rotated and reflecting surface 310 sweeps in close proximity past the sensing surface of photointerrupter 300.

Reflecting surface 310 includes a maximum reflective end 320, adjacent pushrod contact point 330, and a minimum reflective end 325. The distance between axle 235 and the outside boundary of reflecting surface 310 gradually increases from a minimum at minimum reflective end 325 to a maximum at maximum reflective end 320. Thus, the cross-sectional concave arch of reflecting surface 310 increases in size accordingly, as shown in FIGS. 8*a–e*. These drawing figures show swing arm 240 in cross-section taken along line VIII of FIG. 7 in increasing stages of key depression. FIG. 7 shows the swing arm at key rest position. FIGS. 8*a*, 8*b*, 8*c*, & 8*d* show the swing arm at ⅓ travel, ⅔ travel, full depression (i.e., the key travel position wherein the underside of key 200 first contacts silicone rubber strip 345), and maximum after-touch position (i.e., the key travel position wherein strip 345 is at maximum compression) respectively.

FIG. 9 is a close-up cross-section of the lower right portion of FIG. 8*e* showing approximate infrared light paths 350. These lights paths originate from emitter 304, reflect around the concave arch of reflecting surface 310 and terminate at phototransistor detector 306. Swing arm 240 may be injection-formed of white opaque Delrin ®. Thus, reflective surface 310 will naturally be highly reflective. In actual practice, this white opaque reflecting surface may scatter the light beams in a more random fashion than shown in FIG. 9. To reflect the light in a manner more closely resembling paths 350 of FIG. 9, reflecting surface 310 may be coated with a reflective material. FIG. 9 shows the cross-sectional arch adjacent maximum reflective end 320 of reflecting surface 310, wherein this arch forms a complete half-circle. To further increase the efficiency of light reflection at maximum reflective end 320, this end of the reflecting surface 310, which faces opposite end 325, is formed of a half-arch, as can be seen in FIGS. 6 & 7.

When swing arm 240 is in rest position as shown in FIG. 7, reflecting surface 310 is above photointerrupter 300 and reflects almost no infrared light from emitter 304 to detector 306. As key 200 is depressed, swing arm 240 rotates and reflecting surface 310 sweeps in close proximity to photointerrupter 300. During the course of this sweep, the cross-sectional arch of reflecting surface 310 gradually increases in size, as shown in FIGS. 8*a–d*. Consequently, the reflective efficiency of surface 310 increases accordingly. Thus the amount of infrared light reflected onto detector 306 increases as does the detector's voltage output. From this varying voltage output, absolute key position may be determined electronically as described below.

A variation on this key position sensing method is shown in FIGS. 10*a* & 10*b*. Instead of a reflective-type photointerrupter, a transmissive-type photointerrupter 353 provided. The EE-SX1018, manufactured by Omron Corp. of Illinois may be used. This photointerrupter is mounted on the rear side of circuit board 230 and includes a slit-type sensing aperture, not shown, which extends away from this circuit board. A swing arm 355, similar to swing arm 245, is provided, formed of injection-molded black Delrin ®. This swing arm incorporates a semi-circular shutter 360. This shutter extends forward from the forward side of swing arm 355 toward circuit board 230. The semi-circular curve of this shutter is coaxial with axle 235. Photointerrupter 353 is disposed so that shutter 360 sweeps through its sensing slot during key movement.

Shutter 360 extends from a point of minimum depth 365 adjacent pushrod contact point 330 to an endpoint 370 characterized by maximum depth. The depth, or forward-extending length of shutter 360, decreases from point 370 to point 365 as follows: a first down-step 375 is provided which is disposed to sweep past the sensing aperture at one-third of key movement; a second downstep 377 is provided which is disposed to sweep past the sensing aperture at two-thirds of key movement; and a convex-curved portion 380 is provided which begins at point 385 and terminates at the shutter's minimum depth point 365. Point 385 is disposed to align with the sensing aperture when key 200 first contacts strip 345. Point 365 is disposed to align with the sensing aperture when key 200 is at maximum after-touch position (i.e., the key travel position wherein strip 345 is at maximum compression).

The reflecting surface of the embodiment shown in FIGS. 6–9 may also be made to increase reflectivity in a stepwise fashion, resulting in a response curve resembling that of the FIG. 10 embodiment.

MULTI-CONTROLLER MATRIXES

Referring now to FIGS. 11 & 12, an electronic key motion and position sensing system is provided. The system shown in these drawing figures is designed for a 5-level Janko keyboard with 80 notes (in standard tuning configuration) and 200 independent keys (five rows of 40 keys). To achieve a fast sampling rate, a parallel sequential sampling multiplexing system is employed. This system is capable of measuring downstroke velocity, monophonic aftertouch, polyphonic aftertouch, and upstroke velocity.

Each key row is separated into two groups of twenty keys. Each group is implemented on a separate circuit board 230 shown in FIGS. 3 & 6. One circuit board serves the twenty keys on the bass half of each key row, and a second circuit board serves the twenty treble keys. The entire keyboard contains ten key group circuit boards (five rows X two groups per row). Alternately, both key groups per row may be implemented on one circuit board, which would extend the entire length of its key row.

Each key group includes a daughter microcontroller 400 (shown in FIGS. 6 & 11). A master microprocessor 402

(shown in FIG. 11) is provided to receive and process key state information from the 10 groups. The 87C552 is recommended, although other available microprocessors may be used alternately.

The daughter microcontroller 400 includes a group ID feature 403 which includes four output port leads which may individually be connected to ground via removable circuit board traces. The configuration of lead connections for each 20-key group is unique to that group. A four-bit byte unique to each group is thus established which identifies each group to the master processor 402. The daughter controllers communicate with the master processor via a serial inter-integrated circuit bus.

The twenty keys and corresponding photointerupters of each key group are further separated into four sub-groups of five. These sub-groups are served by four photointerrupter input buses 405 which are controlled by four MOSFETs 407. These transistors are controlled by microcontroller 400, which activates at most one input bus at any given moment. Each input bus 405 serves both the photodiode and phototransistor inputs of five photointerrupters 410. Thus, not more than five photointerrupters within each key group are activated at any given moment. A resistor 415 is provided for each photodiode output to equalize current flow through the five photodiodes of each sub-group.

To produce a 76-note keyboard rather than one with 80-notes as described above, each key group may contain 19 keys. In this alternate embodiment, one sub-group of each group would contain four keys (and four photointerrupters) rather than five.

Five phototransistor output buses 420 are provided. One phototransistor output lead from each sub-group is connected to one phototransistor output bus; and each output bus is connected to a different phototransistor output lead from each sub-group.

Each phototransistor output bus is connected to a Schmidt trigger 425 whose output is connected to an input port on group controller 400. Each trigger 425 reads voltage across a resistor 426 and sends a + output when its corresponding key has been depressed beyond a threshold active depth. This depth is between 10 and 30 percent of total key stroke (not including compression of strip 345; see FIG. 6), depending on the response characteristics of the particular photointerrupter.

Microcontroller 400 scans for active keys in five-bit parallel by turning on each of the four input buses 405 in sequence and reading the five-bit byte presented by the triggers 425. Approx. 30 microseconds are required to set up and read each of the four sub-groups. The ten daughter controllers 400 operate simultaneously and asynchronously. Thus, the entire 200-key keyboard can be scanned in approx. 120 microseconds when all keys are in rest position. When a key is first found to be active, a key state change message is sent to the master microprocessor 402 and the key is recorded as being active in a register within controller 400. Controller 400 does not send another message regarding this key until it rises back above active threshold, at which time this event is communicated and recorded in the above-mentioned register.

In addition to Schmidt triggers 425, each phototransistor output bus 420 is also connected to an analog-to-digital (A/D) bus 427 which leads to an A/D converter within processor 402 via a MOSFET 430. These five MOSFETs determine which output bus is connected to the A/D bus. Not more than one of these MOSFETs are turned on at any given time. These MOSFETs are controlled by controller 400.

Active keys are monitored by the master processor 402 for attack velocity, aftertouch (pressure) and release velocity. Once the master processor has been informed that a key is active, it periodically measures the key's precise position by performing an A/D conversion of the key's phototransistor output. To multiplex a particular key for measurement, processor 402 instructs the key's corresponding daughter controller 400 to turn on the proper input bus 405 and output MOSFET 430. This A/D measurement operation takes approx. 50 microseconds, during which time the daughter controller suspends its process of scanning for active keys.

In determining key velocity and aftertouch, processor 402 separates the stroke of each key into four zones: zero (rest position to 33% of key stroke not including compression of pad 345), ⅓ (33% to 67%), ⅔ (67% to aftertouch threshold), and aftertouch. To compensate for differences in photointerrupter response, the A/D values for each key which correspond to the thresholds separating these zones are stored in memory 435. These values are referenced by processor 402 in determining absolute key position. To ascertain these values, a calibration program is performed on the keyboard which measures each key's photointerrupter response.

To measure downstroke and upstroke velocity, processor 402 measures elapsed time during which the key is in zone ⅓. During a downstroke, a velocity message is sent over MIDI as quickly as can be calculated after the key has entered zone ⅔. Then, no A/D conversion is performed on the key for approx. 200 milliseconds to allow the key to come to rest at bottom of stroke. Aftertouch measurements may be performed after this 200 ms pause.

A priority-interrupt hierarchy is established to determine key scanning and measuring operations. The purpose of this hierarchy is to optimize performance of the system during the various situations which the system is likely to encounter. These situations include various combinations of multiple keys simultaneously depressed, held down with modulated aftertouch, and released.

The first operational priority is to scan all keys of the keyboard for activity at least once every 400 microseconds. Priority two is to read absolute position of all downward-moving keys which are in zones zero and ⅓ at least once every 400 microseconds unless this frequency interferes with the first priority, in which case downward-moving key position will be read less often. Priority three is to read absolute position of all upward-moving keys which are in zones ⅔ and ⅓ at least once every 400 microseconds, unless this frequency interferes with either of the first two priorities. Priority four is to read aftertouch. Monophonic aftertouch may be calculated from the polyphonic aftertouch inputs according to various algorithms which have been disclosed in prior art.

Other MIDI functions are performed also, including patch change commands, pedal commands, mod wheel commands, volume change commands, etc. Other functions may be performed also, including alternate note assignments (mapping), velocity-curve translation, and special note-processing functions including the guitar modes discussed below and in this specification's grandparent application. If these various other functions may be performed by master processor 402, then the serial data sent from port 3.1 as shown may be in MIDI format. However, if it is found that an additional processor is required to perform these other functions, then the serial out from processor 402 may be in a different format. It should also be noted that the final output from the controller may be in a non-MIDI form, e.g. a parallel protocol.

The above-described priority-interrupt hierarchy optimizes the trade-off between performance and cost. This conclusion is based on three sets of assumptions regarding: (a) how a keyboard is generally played, (b) what level of performance a musician expects and notices from a keyboard controller, and (c) the limitations of the MIDI serial protocol.

During a typical keyboard performance, it is unusual for more than eight keys to be in transit (between zone zero and aftertouch zone) at one time. Furthermore, it is unusual that more than five of these eight keys would be within the same 20-key group. Thus, priority one will almost always be achieved without sacrificing priorities two and three. To understand why this is so, note that eight keys may be read by the master processor within 400 microseconds (8 times 50 microseconds). Note also that 250 microseconds are required to read five keys within one key group, and the daughter processor then requires 120 microseconds to scan all its keys for changes in active states. 250+120 is less than 400.

As long as each key in transit can be read at least once every 400 microseconds, the velocities of these keys may may be calculated with a satisfactory degree of precision, i.e., with satisfactory resolution. This conclusion is based, in part, on the range of key depression velocities which musicians typically impart with their fingers. Experiments have shown that the transit time for a key to travel through zone ⅓ during a downstroke ranges from a minimum of approx. 1.6 milliseconds to a maximum of approx. 50 milliseconds. The 48.6 ms. difference between these two transit times may be rounded to 48 ms. Assuming the absolute position of each moving key is read once every 400 microseconds, the 48 millisecond range may be divided into 120 velocity increments. The MIDI protocol allows for 127 velocity increments. However, it has been found that very few musicians can detect the difference between 32 well-placed velocity increments and 127. Thus, this system permits sufficient resolution for multiple user-selected velocity response curves.

The primary limitation regarding aftertouch information processing is the MIDI serial protocol. The key-reading system described above provides more than sufficient absolute key position scanning speed to read aftertouch as quickly as MIDI can accept this information.

It should be noted that an alternative method of velocity measurement may be employed with the present invention. This method calculates velocity based on a measurement of the distance of key travel over a pre-determined time interval.

An advantage of splitting the photointerupters of each 20-key group into four sub-groups as shown in FIG. 11 is that no photodiode is in an emitting state for more than 25% of the time when no keys are active. Thus, a relatively high current may be passed through these diodes when they are emitting. This high current produces a bright illumination, resulting in a high signal-to-noise ratio for the phototransistor outputs.

It should be noted that the positions of photointerrupters within each five-key sub-group 405 are staggered at minor-sixth intervals (assuming standard tuning). This staggering virtually assures that no sub-group will be turned on for more than 60% of any sustained time period. Thus, the photodiodes are further protected from overheating. Furthermore, in order to place a set of photodiodes in a 60% operating mode, the musician would have to rapidly and repeatedly strike two notes one minor-sixth apart (in the same row on the same half of the keyboard) while not depressing any other keys. Such a musical performance is unlikely to be sustained for a long time period. Holding down two notes within one sub-group for an extended period would not present an overheating problem because the MIDI protocol only allows one aftertouch message to be sent every 960 microseconds. Thus, there would be no reason for the master processor 402 to perform a 50 microsecond A/D conversion more than once every 960 microseconds on held-down keys. This 50 microsecond increase in photodiode on-time during this period would only raise the on-time percentage of a sub-group to 29%.

One of the operating characteristics of photointerrupters of the type herein recommended is that the phototransistors contained therein exhibit significant rise and fall times during illumination changes. An inverse relationship exists between collector voltage and the duration of these rise and fall times. Thus, since each phototransistor input turns on and off simultaneously with its corresponding photodiode input, the phototransistor fall time is at its maximum when the photodiodes are turned off. For any given key, these off periods never exceed 370 microseconds. Consequently, only a small phototransistor rise time period may be required to elapse when collector voltage is reapplied.

To further reduce this period, a fast-rise circuit may be utilized as shown in FIG. 11. This circuit includes a low-value resistor 440 which is connected to the outputs of the phototransistor output bus MOSFETs 430 and switched to ground via an additional MOSFET 445 wired in series. This MOSFET is controlled by the daughter controller 400. To fast-rise the phototransistors of a given sub-group, MOSFET 445 is turned on at the same time as the sub-group and left on for approx. 10 microseconds. MOSFET 445 is then turned off and the key(s) of the sub-group is (are) read. A diode 450 is provided to prevent resistor 445 from effecting the A/D readings of keys in other groups.

Various alternative scanning systems are possible. For example, each daughter controller may be used to measure key velocity. One system of this type is shown in FIG. 12. This system shares many elements and features with the FIG. 11 system.

Four photointerrupter input buses 460 are provided. Four phototransistor output buses 465 are provided, each connected to five phototransistor output leads. Each of these buses is connected to a ⅓ threshold detector 470 and a ⅔ threshold detector 475. These detectors change output state when their multiplexed keys reach ⅓ of downstroke travel and ⅔ of downstroke travel, respectively. The outputs of the eight threshold detectors (four output buses times two detectors per bus) are presented to daughter controller 480 in 8-bit parallel.

To measure downstroke and upstroke velocity, controller 480 measures elapsed time between the triggering of the two detectors. This transit time is then coded and sent to master processor 485. To compensate for differences in photointerrupter response characteristics, master processor 485 may consult a table 490 and correct the velocity values received from controller 480. Alternately, the key calibration may be performed by controller 480 if sufficient memory and processing power are available.

Still other key calibration methods are possible as well. For example, the values of photodiode resistors 415 may be customized for each key. Also, the distance between each reflecting surface 310 and its corresponding photointerrupter 300 (see FIGS. 6–9) may be physically adjusted. One method by which this adjustment may be accomplished utilizes a turnscrew feature incorporated into axle 235. This feature is not shown.

To accommodate the potentially large hysteresis curves of Schmidt triggers 425 and threshold detectors 475, 470, an alternate system configuration may be employed. In this configuration, not shown, the photointerrupter response to key stroke is reversed, i.e., when the key is in up position, phototransistor output current is at maximum. This response may be produced by inverting the light-modulating features of swing arms 240, 355. Referring to FIG. 11, Schmidt triggers 425 may easily be reset to produce a—output by turning off all input buses 405. When an input bus 405 is then turned on, a voltage proportional to key elevation is produced across load resistors 426. These load resistors 426 are selected of the appropriate value so that the output of each trigger 425 switches to + when its read key is in rest position, and remains at—when its read key is below approx. twenty percent of travel.

Referring again to FIG. 11, to accommodate potentially large hysteresis curves without reversing photointerrupter response, a fifth input bus 405 may be provided. This bus is not connected to any photointerrupter inputs. Rather, this bus is connected directly to the output buses 420 via one diode per output bus. These diodes are to prevent crosstalk between the output buses during key reading. To check keys for activity, the fifth input bus is turned on, setting the Schmidt triggers to + output. Then, one of the other four input buses 405 is turned on and the fifth input bus is turned off. If a key being read is in rest position, its corresponding trigger 425 will switch to output. If a key is depressed below approx. 20% of travel, its corresponding trigger 425 will continue a + output.

SINGLE PROCESSOR MATRIXES

Single-processor key scanning circuits may be employed instead of the master-daughter systems described above. Various matrixes may be utilized for single-processor circuits. Two such matrixes are described below and shown in FIGS. 13 and 14.

To provide a shorthand means for notating photointerrupter matrix configurations, a specific format is used in this specification. This format is particularly handy when describing single-processor matrixes. This format consists of two numbers each in two sets of parentheses. The two numbers within each parentheses set are multiplied by each other, and the two parentheses sets are multiplied by each other. Substituting letters for the four numbers, this format appears as follows:

(AXB)X(CXD)

The first character (A) refers to the number of photodiode input buses.

The second character (B) refers to the number of photodiode output buses.

The third character (C) refers to the number of phototransistor input buses.

The fourth character (D) refers to the number of phototransistor output buses.

By multiplying all four numbers by each other, one may determine the total number of keys which a particular matrix may accommodate.

FIGS. 13 and 14 show a (2×5)×(4×5) and a (3×4)×(2×8) matrix, respectively.

In each of these matrixes, the photodiode and phototransistor input buses are separate and operate independently. Thus, the photodiode and phototransistor inputs may each be used as matrix grid variables. By using the photodiode and phototransistor outputs as variables also, many keys may be accommodated with few input and output buses. Consequently, few logic components are required to perform the scanning and switching operations. A single inexpensive processor may be used. Also, few wires are required to connect the mother board with the key row matrix circuit boards (although fewer still may be required when daughter controllers are used as in FIGS. 11 & 12).

FIGS. 13 & 14 are simplified circuit diagrams. Various elements are not shown including load resistors, phototransistor ground connections, Schmidt triggers/threshold detectors, and A/D converter buses a related elements.

The FIG. 13 & 14 circuits may be used with Schmidt Trigger key sensing circuits of the type shown in FIG. 11. These triggers would operate from the phototransistor output buses 500, 505–507 and would present input to the left side central processing unit (CPU) ports 510 & I-P.

Alternately, the FIG. 13 a 14 circuits may be used with double threshold detectors of the type shown in FIG. 12. With this embodiment, the number of required CPU inputs would be double the amount shown; i.e., the CPU 511 of FIG. 13 would require ten inputs, and the FIG. 14 CPU 512 would require sixteen.

A/D conversions may be multiplexed in a manner similar to that shown in FIGS. 11 & 12.

Referring to FIG. 13, a matrix accommodating up to 200 keys (five rows of 40) is provided. Each key row is served by two identical circuit boards, a bass board 515, and a treble board 517. Bass board 515 is electrically connected directly to the mother board 520. Treble board 517 is connected to mother board 520 via bass board 515.

The six photointerrupter input buses are selectively switched on by six MOSFETs which are controlled by CPU 511 as shown. The five photodiode output buses are selectively switched to ground by five MOSFETs 530 which are also controlled by CPU 511 as shown. Not more than one photodiode input bus, one phototransistor input bus, and one photodiode output bus are activated at any given moment.

Five phototransistor output buses are provided, one for each key row. The phototransistor outputs within each key row are summed into their corresponding buses. Thus, not more than five keys (one key from each row) may be read at one time.

Referring to FIG. 14, a matrix accommodating 190 keys (five rows of 38) is provided. Note that (3×4)×(2×8) multiplies out to 192. Thus, two unused matrix coordinates are left over. Each key row is served by two circuit boards, a bass board 540, and a treble board 545. Bass board 540 is electrically connected directly to the mother board 550. Treble board 545 is connected to mother board 550 via bass board 540.

Circuit boards 540, 545 are identical as initially constructed. However, a double-pole single-throw switch 555 is incorporated into the circuit trace design. This switch in each circuit board 540, 545 is hardwired into one position or the other at the factory before final keyboard construction. The function of this switch is to determine whether twelve phototransistor inputs will be controlled by CPU port T or U.

The two phototransistor input bus leads from each of the five key rows are connected to the same MOSFET outputs. These MOSFETS correspond with the T & U outputs from CPU 512 as shown.

However, the three photodiode input buses 565–567 and the four photodiode output buses 575–578 of different key rows are wired to different MOSFETs. Also, the three phototransistor output buses 505–507 of the different key rows are wired to present data to different CPU inputs.

FIG. 15 shows a table detailing the assignment of key row circuit board buses with CPU ports. FIG. 15 also shows the position of switch 555 for each circuit board.

An advantage of the FIG. 14 matrix is that it allows eight keys to be read at once, rather than five.

Other matrixes are possible as well, including (3×4)×(4×4).

(5×3)×(2×7) may be implemented on fifteen circuit boards, three per key row. This matrix also provides twenty unused matrix coordinates (for a 76-note 5-row Janko keyboard), which may be used to accept data from pedals, mod wheels, ribbon controllers, control panel switches, knobs, etc.

(2×3)×(5×8) may be employed for an 88-note 5-row Janko Keyboard (5 rows of 44 keys). This matrix also provides twenty unused matrix coordinates.

It should be noted that the positions of the four numbers within these expressions may be interchanged.

ALTERNATE SENSING METHODS

Additional methods of sensing key position/velocity may be employed with the present invention. These methods may be used with conventional musical keyboards, Janko Keyboards and other types of keyboards as well.

Various double-photointerrupter sensing methods are disclosed in the prior art, for example, U.S. Pat. No. 4,362,934 (McLey). The sensing methods shown in FIGS. 7–10 may be modified (not shown) to operate two photointerrupters per key.

FIGS. 16 & 17 show capacitive sensing methods which may be used with the present invention.

Referring to FIG. 16*a* & 16*b*, a swinging vane capacitor plate 600 is provided. This vane is attached to swing arm 605 on the opposite side of axle 610 from pushrod contact point 615. Vane 600 is formed of aluminum or other electrically conductive material and is disposed parallel to and in close proximity to circuit board 620.

A Bellville washer 625 is provided to electrically connect vane 600 to a trace on circuit board 620. A second stationary capacitor plate 630 is provided on circuit board 620. This stationary plate is printed on the circuit board as part of the printed trace pattern and matches the shape and area of vane 600.

When the key is in rest position, vane 600 is separated from plate 630 as shown. When the key is in maximum depressed position, vane 600 completely overlaps plate 630. Using air as a dielectric, the capacitance between vane 600 and plate 630 is measured.

A variation on this capacitive sensing method is shown in FIG. 17. In this embodiment, the vane 650 is floating, i.e., the vane is not electrically connected to the sensing circuit. Two plates 660, 665 are provided, each printed on the circuit board. When the key is in rest position, only first plate 660 is overlapped by vane 650 as shown. When the key is in maximum depressed position, both plates are overlapped. Vane 650 causes the capacitance between the two plates to increase when the key is depressed. Vane 650 and swing arm 667 may be injection-formed together as one piece. The conducting plate portion of vane 650 may be created by application of a conductive spray-on or brush-on material, such as #22-207 Nickel Print, from GC Electronics Co. of Rockford, Ill.

The capacitance modulation of both of the above two sensing methods may be increased by the addition of a second circuit board 675 (see FIG. 16*a*) which includes a second capacitive plate (FIG. 16) or pair of plates (FIG. 17). This second circuit board may be mounted parallel to the first circuit board between arm 605, 667 and vane 600, 650.

The method of FIG. 16 may be modified to provide an inductive sensing method by replacing plate 630 with a serpentine coil (not shown). Various prior art patents describe how a printed serpentine coil of this type may be employed as a key position sensor. In this variation of the FIG. 16 embodiment, Bellville washer 625 and second circuit board 675 are unneeded.

Referring now to FIG. 18, an alternate inductive sensing method is shown. A coil 700, comprising many wire turns wound on a bobbin 703, is attached to circuit board 705. Coil 700 is disposed so that rear guide pin 710 is inserted through the center of the coil during key depression. Since pin 710 is formed of mild steel, it acts as a core rod and increases the coil inductance during key downstroke. Alternately, the coil bobbin 703 and the rear guide bushing 715 may be injection-formed together as one piece (not shown).

Alternately, the bottom end of front guide pin 229 (see FIG. 6) may be used as a moving core rod (this variation not shown).

Also, a guide pin attached to a key of a lever-type keyboard, for example as in U.S. Pat. No. 474,016 (Von Janko), may be used as a moving core rod (not shown).

Yet another sensing method which may be used with the present invention utilizes the swing arm 240 as the rotor of a potentiometer (not shown). As with a conventional stand-alone rotary potentiometer, brushes (not shown) may be attached to the swing arm and may trace an arcurate path over traces on circuit board 230. Similarly, the key sensing method shown in U.S. Pat. No. 4,273,017 (Dodds et al.) may be employed with the swing arm of the present invention.

Still another sensing method utilizes the swing arm to depress a soft silicone rubber dome switch (not shown). This switch may be mounted on the rear side of circuit board 230 directly below swing arm 240. The sweeping motion of the underside edge of the swing arm depresses the dome switch. The dome switch shown in U.S. Pat. No. 5,278,374 (Takagi) and denoted by reference number 6*b* is particularly well-suited to this application, since this switch is engineered to accommodate side force. The contact portion of this switch may be modified to provide key velocity sensing via a double-buss (double-contact) system, as will be apparent to those familiar with present-day musical keyboard keyswitch art.

SPECIAL MIDI FUNCTIONS

This specification's grandparent application describes several special MIDI functions which may be utilized with the present invention. Following are some additional special functions.

To further enable the keyboard to produce rhythm guitar strumming effects, several additional "guitar modes" may be programmed. These each utilize a sampler or other sound module (not shown) to play back individual guitar note samples.

One guitar mode is similar to the guitar application of Sub-Zones Repetition mode described in the grandparent application. However, instead of recording entire guitar chord strum samples in the sound module, samples of individual guitar notes are recorded. Thus, the specific chord voicings which form the chord may be user or factory-programmed and stored in the keyboard's memory.

When a key in rows one or two is depressed, a note-off command followed by a note-on command is transmitted for each of the notes of the pre-programmed chord in sequence, from lowest to highest pitch. The serial code thus reads as follows: lowest note off, lowest note on, next highest note off, next highest note on, etc. The effect is to produce a guitar down-strum. When the row three or four key of the same note in the same octave is depressed, the same notes are muted and triggered in sequence from highest to lowest pitch. An upstrum is thus produced.

The velocity commands of these notes are proportional to the downstroke key velocities.

The time interval between muting/triggering of adjacent notes in the chord sequence is determined by a measuring function in the keyboard software which measures elapsed time between strikings of the down-strum and up-strum keys. The measuring function increases the time interval between muting/triggering of adjacent notes in the chord sequence proportionally with the elapsed time between key strikings. Thus, a realistic guitar strum effect is produced for all strum tempos, from rapid energetic performances to slow relaxed strums. Since the measuring function cannot calculate the strum rate of the first key strike strum of a performance, a predetermined average strum rate is assigned. Elapsed times greater than a predetermined period (e.g., one half-second) are interpreted as a performance pause. Thus, the last strum rate used is assigned to the next keystrike.

Key release strokes are processed as in Sustain mode, described in the grandparent specification. Thus, after the downstroke and upstroke keys are depressed and held down, one or the other may be repeatedly released and depressed with no note muting occurring as a result of the key upstroke. Multiple sequential downstrums may thus be produced without upstrums and vice versa.

A variation on this method uses keys within another zone of the keyboard to determine the notes within the strummed chords. For example, the musician may depress and continuously hold down four notes with one hand in one zone of the keyboard. The thumb and index finger of the other hand may then play downstrum and upstrum trigger keys in a different keyboard zone. The trigger keys trigger the notes of the held-down keys as described above.

Using held-down keys and separate trigger keys, guitar performance may be even more closely duplicated as follows:

The sampled guitar notes are edited so that the attack portion of the sound (i.e., the sound of the pick striking the string) is separated from the sustaining tone of the vibrating string. The attacks and sustains are stored in the sampler sound module as separate sampled sounds. The module is programmed so that the attack sounds may be triggered separately from the sustaining tones. When a set of note-selecting keys are held down below a predetermined aftertouch threshold, both attack and sustain portions of the samples are triggered and the guitar strums produce chords, as one would normally expect. However, when the note-selecting keys are held down lightly, i.e., above a predetermined aftertouch threshold, then only the attack samples are triggered. Thus, a chucka-chucka sound is produced. With the note-selecting keys depressed by the left hand and the trigger keys played by the right, both the sounds and performance inputs to produce these sounds will be very familiar to a typical guitarist. With polyphonic aftertouch, the sustain portions of individual notes may be selectively deleted and re-introduced in real-time during a performance.

Alternately, instead of using two keys to trigger chords, a single key or foot pedal may be used to trigger downstrums and upstrums via key downstrokes and upstrokes, respectively.

It should be noted that both of the above-described guitar modes may be utilized with a conventional 7-5 keyboard. However, since the Janko keyboard with independent keys described above has thirty keys per octave, it is particularly well-suited to the guitar mode with programmed strum notes. Also, the shortened octave span of the Janko keyboard enables one hand to reach a larger chord. Thus, more authentic guitar voicings may be reached with one hand. This is yet another reason why the independent-key Janko keyboard is particularly well-suited to these special functions.

This specification's grandparent application mentions the special versatility of an independent-key 5-row Janko keyboard when alternate MIDI note-mapping is possible. The following alternate note-mapping configuration is particularly worth recommending: The uppermost treble and lowermost bass octaves of the first two rows may be programmed to trigger notes an octave higher, and an octave lower than standard, respectively. Thus, a 76-note (190 key) keyboard may play the notes of a 100-note keyboard. This reprogramming of 24 keys hardly effects performance within the original 76 notes because the reprogrammed keys are rarely used when programmed conventionally. The reason for this rare usage is that the keys of rows one and two are played almost exclusively by the thumbs. Thus, since the thumbs are on the "inboard" side of the hands, the keys on the extreme ends of the keyboard are usually played by the other fingers, particularly the smallest (pinky) fingers. Alternately, the keys of rows one and two on the ends of the keyboard may be assigned to patch control.

PREDICTIVE GEOMETRIC ANALYSIS

To efficiently engineer a satisfactory embodiment of the invention it is recommended that the geometry of a proposed pushrod, swing arm, and return spring be first analyzed prior to actual construction. The traditional format for graphing key touch resistance to downward key stroke displays touch resistance on the vertical axis, or Y; and downward key displacement on the horizontal axis, or X.

Referring to FIG. 19, downward key displacemant is shown by the letter X and the upward force component of the pushrod against the key is shown by the letters Y and $Y_1$.

GIVEN VALUES:

h=Horizontal distance from swing arm pivot point (axle) to top end of pushrod in mm.

i=Initial spring force in grams.

k=Spring constant or rate of increase in spring force due to deflection in grams/mm.

L=Initial elevation difference from axle to top end of pushrod in mm.

o=Distance from axle to stationary spring anchor in mm.

p=Distance from axle to moving spring anchor in mm.

r=Distance from axle to lower end of pushrod in mm.

s=Initial spring length in mm.

t=Length of pushrod in mm. (Precisely, this dimension should be the distance between the top and bottom radii centers of the semi-spherical contact tips.)

x=Downward displacement of the key in mm.

DERIVED VALUES:

$Y$ = Initial upward force of key in grams = $V(\cos N)$ $Y_1$ = Deflected upward force of key in grams = $V_1(\cos N_1)$ $N$ = Initial angle between pushrod axis and key stroke axis in degrees = $|G + Q - 90°|$ $N_1$ = Deflected angle between pushrod axis and key stroke axis in degrees = $|G_1 + Q_1 - 90°|$ $G$ = Initial angle from horizontal of a line defined by the axle and the top pushrod end in degrees = $a\tan\left(\frac{L}{h}\right)$ $G_1$ = Deflected angle from horizontal of a line defined by the axle and the top pushrod end in degrees = $a\tan\left(\frac{L-x}{h}\right)$ $Q$ = Initial angle between pushrod axis and a line defined by the axle and the top pushrod end in degrees = $a\cos\left(\frac{t^2+M^2-r^2}{2\cdot t\cdot M}\right)$ $Q_1$ = Deflected angle between pushrod axis and a line defined by the axle and the top pushrod end in degrees = $a\cos\left[\frac{t^2+(M_1)^2-r^2}{2\cdot t\cdot M_1}\right]$ $M$ = Initial distance between axle and top of pushrod in mm. = $\sqrt{h^2+L^2}$ $M_1$ = Deflected distance between axle and top of pushrod in mm. = $\sqrt{h^2+(L-x)^2}$ $V$ = Initial force of pushrod in grams = $\frac{w}{\cos C} = \frac{\frac{J\cdot p}{r}}{\cos C} = \frac{J\cdot p}{r\cdot(\cos C)}$ $V_1$ = Deflected force of pushrod in grams = $\frac{w_1}{\cos C_1} = \frac{\frac{J_1\cdot p}{r}}{\cos C_1} = \frac{J_1\cdot p}{r\cdot\cos C_1}$ $C$ = Initial angle between torque force component of swing arm and pushrod axis in degrees = $|U - 90°|$ $C_1$ = Deflected angle between torque force component of swing arm and pushrod axis in degrees = $|U_1 - 90°|$ $U$ = Initial angle between pushrod axis and a line defined by axle and bottom pushrod end in degrees = $a\cos\left(\frac{t^2+r^2-M^2}{2\cdot t\cdot r}\right)$ $U_1$ = Deflected angle between pushrod axis and a line defined by axle and bottom pushrod end in degrees = $a\cos\left[\frac{t^2+r^2-(M_1)^2}{2\cdot t\cdot r}\right]$ $W$ = Initial torque component of swing arm at pushrod contact point in grams = $\frac{J\cdot p}{r}$ $W_1$ = Deflected torque component of swing arm at pushrod contact point in grams = $\frac{J_1\cdot p}{r}$ $J$ = Initial torque force component of swing arm at spring contact point in grams = $i\cdot(\cos Z)$ $J_1$ = Deflected torque force component of swing arm at spring contact point in grams = $i_1\cdot(\cos Z_1)$ $Z$ = Initial angle between torque force component of swing arm at spring contact point and spring axis in degrees = $|E - 90°|$ $Z_1$ = Deflected angle between torque force component of swing arm at spring contact point and spring axis in degrees = $|E_1 - 90°|$ -continued $E$ = Initial angle between spring axis and a line defined by axle and spring contact point on swing arm in degrees $= acos\left(\frac{s^2+p^2-o^2}{2\cdot s\cdot p}\right)$ $E_1$ = Deflected angle between spring axis and a line defined by axle and spring contact point on swing arm in degrees $= acos\left[\frac{(S_1)^2+p^2-o^2}{2\cdot S_1\cdot p}\right)$ $S_1$ = Deflected spring length in mm. $= \sqrt{p^2+o^2-2\cdot p\cdot o(\cos(F+D))}$ $i_1$ = Deflected spring force in grams $= i + k(S_1 - s)$ $F$ = Initial angle between a line defined by axle and stationary spring anchor and a line defined by axle and spring contact point on swing arm in degrees $= acos\left(\frac{p^2+o^2-s^2}{2\cdot p\cdot o}\right)$ $D$ = Degrees of swing arm rotation due to key depression $(x) = (A_1 + B_1) - (A + B)$ $A$ = Initial angle between a line defined by axle and swing arm/pushrod contact point and a line defined by axle and upper pushrod contact point in degrees $= acos\left(\frac{r^2+M^2-t^2}{2\cdot r\cdot M}\right)$ $B$ = Initial angle of a line defined by axle and upper pushrod contact point from vertical in degrees $= atan\left(\frac{H}{L}\right)$ $A_1$ = Deflected angle between a line defined by axle and swing arm/pushrod contact point and a line defined by axle and upper pushrod contact point in degrees $= acos\left[\frac{r^2+(M_1)^2-t^2}{2\cdot r\cdot M_1}\right]$ $B_1$ = Deflected angle of a line defined by axle and upper pushrod contact point from vertical in degrees $= atan\left(\frac{H}{L-x}\right)$ Solved for given values, $Y_1$ =

$$\frac{i+k\cdot\left[\sqrt{p^2+o^2-2\cdot p\cdot o\cdot\cos\left[acos\left(\frac{p^2+o^2-s^2}{2\cdot p\cdot o}\right)+acos\left[\frac{r^2+h^2+(L-x)^2-t^2}{2\cdot r\cdot\sqrt{h^2+(L-x)^2}}\right]+atan\left(\frac{h}{L-x}\right)-acos\left(\frac{r^2+h^2+L^2-t^2}{2\cdot r\cdot\sqrt{h^2+L^2}}\right)-atan\left(\frac{h}{L}\right)\right]}-s\right]}{r\cdot\cos\left[\left|acos\left[\frac{t^2+r^2-h^2-(L-x)^2}{2\cdot t\cdot r}\right]-90^\circ\right|\right]}$$

multiplied by $$\cos\left[\left|acos\left[\frac{p^2+o^2-2\cdot p\cdot o\cdot\cos\left[acos\left(\frac{p^2+o^2-s^2}{2\cdot p\cdot o}\right)+acos\left[\frac{r^2+h^2+(L-x)^2-t^2}{2\cdot r\cdot\sqrt{h^2+(L-x)^2}}\right]+atan\left(\frac{h}{L-x}\right)-acos\left(\frac{r^2+h^2+L^2-t^2}{2\cdot r\cdot\sqrt{h^2+L^2}}\right)-atan\left(\frac{h}{L}\right)\right]+p^2-o^2}{2\cdot\sqrt{p^2+o^2-2\cdot p\cdot o\cdot\cos\left[acos\left(\frac{p^2+o^2-s^2}{2\cdot p\cdot o}\right)+acos\left[\frac{r^2+h^2+(L-x)^2-t^2}{2\cdot r\cdot\sqrt{h^2+(L-x)^2}}\right]+atan\left(\frac{h}{L-x}\right)-acos\left(\frac{r^2+h^2+L^2-t^2}{2\cdot r\cdot\sqrt{h^2+L^2}}\right)-atan\left(\frac{h}{L}\right)\right]\cdot p}}\right]-90^\circ\right|\right]\cdot p$$

multiplied by

-continued $$\cos\left[\left|\operatorname{atan}\left(\frac{L-x}{h}\right)+\operatorname{acos}\left[\frac{t^2+h^2+(L-x)^2-r^2}{2\cdot t\cdot\sqrt{h^2+(L-x)^2}}\right]-90^\circ\right|\right]$$

The initial upward key force (Y) may be calculated using the deflected algorithm by assigning a zero value to X.

To plot a response curve, a series of Y values may be calculated corresponding with an ascending series of X values. For example, since a typical desired key dip for a musical keyboard is approximately 8 mm, nine Y values may be calculated based on X=0–8. These nine graphed points will provide a clear representation of the key touch response.

This analysis assumes no friction.

The proportions shown in FIGS. 19 & 20 are for illustration only. For example, the large angular displacement (angle D) of the swing arm shown is not recommended. Also, FIGS. 19 a 20 viewed together may be seen to imply that the distance from the axle to the spring contact point is greater than the distance from the axle to the pushrod contact point, although this is neither intended nor recommended.

This algorithm may be applied to either of the preferred embodiments hereinabove disclosed.

SUMMARY, RAMIFICATIONS AND ADDITIONAL DESIGN OPTIONS

It will be seen by those skilled in the art that the present invention fully satisfies the objects set forth. With this invention a key return and motion sensing mechanism may be engineered which is, at once, compact, lightweight, quiet in operation, easy to assemble and repair, and inexpensive to manufacture. The moving parts as shown may easily be engineered to undergo thousands of cycles of operation without failure.

The mechanisms shown in the drawing figures are characterized by low friction; however, the axles and pushrod contact points may be increased in size, resulting in increased friction. A friction element is sometimes considered desirable in keyboard design, as noted in various prior art, including U.S. Pat. No. 4,890,533 (Katsuta) (text column 2, lines 11–28) and others.

The mechanism of the invention may easily be engineered to provide decreasing downstroke resistance, or a near flat response curve, if desired.

The invention represents a major breakthrough in independent-key Janko Keyboard design. A typical desired key dip for a musical keyboard is approx. 8 mm. The typical operating displacement for various prior art key sensing devices is less than 5 mm. These devices include button, or dome switches, and double-buss contact coil springs. Since the keys do not rock on fulcrums, there is no obvious practical way to convert the 8 mm key stroke to a 5 mm sensing device stroke without adversely affecting the key touch response. The swing arm solves this problem by providing a rotational moving component which can incorporate a sensor driving member with a reduced radius, and thus, with a reduced stroke. An example of this principle, wherein the swing arm incorporates a contact spring reciprocating member, is shown in this specification's grandparent application, FIG. 13. This reciprocating member may be employed with the herein disclosed conventional keyboard embodiment as well.

It should be understood that the specific forms of the invention hereinabove described are intended to be representative only, as certain modifications within the scope of these teachings will be apparent to those skilled in the art. For example, other key position sensing systems may be employed including piezoelectric sensors and magnetic sensors, including Hall Effect sensors. Other fulcrum, key travel limiting, bushing and guide means may be employed as well. Other key return means may be utilized to provide return force to the swing arms, including weights, leaf springs, rubber pads, torsion springs, spiral springs (e.g. clock springs), and compression coil springs.

As an additional option, an additional member may be incorporated with the swing arm of the present invention to increase inertial key depression resistance. This additional member (not shown) may support a weight (of lead or other heavy material) at a distance from the axle greater than the distance from the axle to the pushrod drive point. Thus, the weight would move more quickly than the key during key depression and the inertial resistance introduced by the weight would be greater than the resistance introduced if the same weight were instead simply attached to the key. Consequently, a small weight could be used to achieve a relatively large inertial resistance.

The hereinabove described inductive return spring/sensor and optical sensor may each be used in lever-type keyboards without swing arms. To use the optical sensor in such a keyboard, a reflective member may be attached directly to each key rather than to a swing arm (not shown). The portion of the reflective member which modulates reflected light (with key movement) could face toward the front, rear or either side of the keyboard and be arc-shaped in correspondence with the arc of the key movement (rather than in correspondence with an arc of swing arm movement), or may be linear in shape.

I claim:

1. A keyboard for a finger-operated device comprising:

a chassis, at least one key reciprocatively mounted on said chassis, a substantially planar circuit board mounted on said chassis, said circuit board defining a plane, a swing arm rotatably mounted on said chassis, said swing arm rotating about an axis of swing arm rotation, wherein said swing arm is disposed to rotate as a result of reciprocative movement of said key, and;

said swing arm is disposed with said axis of swing arm rotation substantially perpendicular to said circuit board plane.

2. A keyboard as in claim 1, further comprising, a contact spring reciprocating member on said swing arm.

3. A keyboard as in claim 1 further comprising, a swing arm axle and a bore in said circuit board wherein, said axle is at least partially anchored in said bore.

4. A keyboard as in claim 1 wherein said key reciprocation is linear.

5. A keyboard as in claim 1 wherein, said circuit board includes a sensor device.

6. A keyboard as in claim 5 wherein, said sensor device is a photointerrupter.

7. A keyboard for a finger-operated device comprising:

a chassis, a longitudinal row of keys defining a keyboard axis, at least one key within said key row reciprocatively mounted on said chassis, and a swing arm rotatably mounted on said chassis, said swing arm rotating about an axis of swing arm rotation, wherein said swing arm is disposed to rotate as a result of reciprocative movement of said key, and;

said swing arm is disposed with said axis of swing arm rotation substantially perpendicular to said keyboard axis.

8. A keyboard as in claim 7 wherein, said key drives said swing arm via a firm link.

9. A keyboard as in claim 7 wherein, said key comprises a guide pin which also serves as a driving member for said swing arm.

10. A keyboard as in claim 9 wherein, said guide pin drives said swing arm via a firm link.

11. A keyboard as in claim 7 wherein, said swing arm rotates about a pivot point, said key applies a driving force vector to said swing arm at a driving contact point, with said pivot and driving contact points defining a line, said line and said driving force vector defining an angle, wherein, said angle is obtuse at key rest position.

12. A keyboard as in claim 7 further comprising a key return element wherein, said swing arm rotates about a pivot point, said key return element applies a return force vector to said swing arm at a return force contact point, with said pivot and return force contact points defining a line, said line and said return force vector defining an angle, wherein, said angle is obtuse at key full depression position.

13. A keyboard as in claim 7 wherein, said swing arm is geometrically configured to provide said key with decreasing downstroke resistance.

14. A keyboard as in claim 7 further comprising a circuit board wherein, said key reciprocates along a key motion axis, said key motion axis and said keyboard axis defining a planar axis, and, said circuit board is disposed approximately parallel to said planar axis.

15. A keyboard as in claim 7 wherein said key reciprocates along a key motion axis and, said swing arm is disposed with said axis of swing arm rotation approximately perpendicular to said key motion axis.

16. A keyboard as in claim 7 wherein said key reciprocation is linear.

17. A keyboard as in claim 7 wherein said keyboard is a conventional musical keyboard further comprising, a black keys circuit board and a white keys circuit board wherein, said black keys circuit board is disposed to the rear of said white keys circuit board.

18. A keyboard for a finger-operated device comprising:

a chassis;

a row of keys defining a longitudinal keyboard axis;

at least one key reciprocatively mounted on said chassis;

a swing arm rotatably mounted on said chassis, said swing arm rotating about an axis of swing arm rotation; and a key return element; wherein, said swing arm is disposed to rotate as a result of reciprocative movement of said key;

said swing arm is disposed with said axis of swing arm rotation substantially perpendicular to said keyboard axis;

said key applies a driving force vector to said swing arm at a driving contact point;

said key return element applies a return force vector to said swing arm at a return force contact point; and said return force contact point is, longitudinally, disposed between said pivot point and said driving contact point.

19. A keyboard as in claim 18 wherein, said key return element comprises an extension coil spring.

20. A keyboard as in claim 19 wherein, said spring is approximately vertically disposed and extends upward from said swing arm.

21. A keyboard for a finger-operated device comprising:

a chassis;

a row of keys defining a longitudinal keyboard axis;

at least one key reciprocatively mounted on said chassis;

a swing arm rotatably mounted on said chassis, said swing arm rotating about an axis of swing arm rotation; and a key return element; wherein, said swing arm is disposed to rotate as a result of reciprocative movement of said key;

said swing arm is disposed with said axis of swing arm rotation substantially perpendicular to said keyboard axis;

said key applies a driving force vector to said swing arm at a driving contact point;

said key return element applies a return force vector to said swing arm at a return force contact point; and said axis of swing arm rotation is, longitudinally, disposed between said driving contact point and said return force contact point.

22. A keyboard as in claim 21 wherein, said key return element comprises an extension coil spring.

23. A keyboard as in claim 22 wherein, said spring is diagonally disposed, extending downward from said return force contact point and longitudinally from said return force contact point in the direction of said driving contact point.

* * * * *

UNITED STATES PATENT AND TRADEMARK OFFICE

CERTIFICATE OF CORRECTION

PATENT NO. : 5,505,115
DATED : April 9, 1996
INVENTOR(S) : Paul B. Vandervoort

It is certified that error appears in the above-indentified patent and that said Letters Patent is hereby corrected as shown below:

On the title page, item [56]:

Related U.S. Application Data:

App. Serial # 040,209 was not abandoned, and issued on 11-28-95 as U.S. Patent #5,469,772.

Numerous "&" characters were incorrectly printed as "a" characters.

Column 3, line 47, should read as follows:

To compensate for the increase in spring force due to spring deflection and/or to provide decreasing downstroke resistance, the driving force vector (shown in a pushrod embodiment in FIG. 19, denoted by *) is applied to the swing arm at an obtuse angle (one such angle is shown in FIG. 19 denoted by U) when the key is at rest position; and the return force vector (shown in FIG. 20, denoted by $I_1$) is applied to the swing arm at an obtuse angle (see FIG. 20, angle $Z_1$ + 90°) when the key is fully depressed.

The related application for "Tactile Key Tops", mentioned in text column 1, line 30, is being issued 5-14-96 as U.S. Patent # 5,515,763.

Signed and Sealed this

Fifth Day of November, 1996

*Attest:*

BRUCE LEHMAN

*Attesting Officer*

*Commissioner of Patents and Trademarks*